US010500760B2

(12) United States Patent
Eggleston, II

(10) Patent No.: US 10,500,760 B2
(45) Date of Patent: Dec. 10, 2019

(54) METHOD AND APPARATUS FOR PRODUCTION OF PRECISION PRECAST CONCRETE FLIGHTS OF STAIRS

(71) Applicant: Richard J. Eggleston, II, Asotin, WA (US)

(72) Inventor: Richard J. Eggleston, II, Asotin, WA (US)

( * ) Notice: Subject to any disclaimer, the term of this patent is extended or adjusted under 35 U.S.C. 154(b) by 661 days.

(21) Appl. No.: 15/048,548

(22) Filed: Feb. 19, 2016

(65) Prior Publication Data

US 2017/0239838 A1 Aug. 24, 2017

(51) Int. Cl.

| | |
|---|---|
| ***B28B 7/22*** | (2006.01) |
| *E04F 11/02* | (2006.01) |
| *B28B 7/34* | (2006.01) |
| *B28B 7/00* | (2006.01) |

(52) U.S. Cl.

CPC ..... *B28B 7/225* (2013.01); *B28B 7/0064* (2013.01); *B28B 7/346* (2013.01); *E04F 11/02* (2013.01); *E04F 2011/0212* (2013.01)

(58) Field of Classification Search

None

See application file for complete search history.

(56) References Cited

U.S. PATENT DOCUMENTS 1,012,735 A * 12/1911 Smock ..... B28B 7/225 249/14
1,703,633 A 2/1929 Newcomb
1,703,663 A * 2/1929 Harrison ..... G01R 11/04 200/50.18
2,052,446 A * 8/1936 Cannon ..... E04G 13/062 249/14
2,252,614 A * 8/1941 Bowen ..... A47J 31/18 66/172 E
2,548,703 A * 4/1951 Cline ..... B28B 7/225 249/14
2,702,931 A * 3/1955 Johnson ..... B28B 7/225 249/119
3,212,155 A * 10/1965 Francis, Jr. ..... B28B 7/225 249/123
3,269,688 A * 8/1966 Hulicki ..... B28B 7/225 249/14
3,281,110 A * 10/1966 Lister ..... B28B 7/225 249/137
3,780,976 A * 12/1973 Messier ..... B28B 7/225 249/122

(Continued)

FOREIGN PATENT DOCUMENTS

DE 1106666 B * 5/1961 ..... B28B 7/18
EP 0941825 A2 * 9/1999

(Continued)

*Primary Examiner* — Seyed Masoud Malekzadeh
*Assistant Examiner* — Manley L Cummins, IV
(74) *Attorney, Agent, or Firm* — Randall Danskin P.S.

(57) ABSTRACT

An apparatus and method for precision forming a precast concrete flight of stairs is disclosed and where precision cut form components provide plural tread supports, plural sideboards, plural tread/riser combinations and a center tread support that upon assembly, the form components, automatically square and align treads and risers with upper and lower landings for installation to provide access between vertically spaced apart floors of a structure.

4 Claims, 16 Drawing Sheets

(56) References Cited

U.S. PATENT DOCUMENTS 3,836,109 A * 9/1974 Lister ..... B28B 7/0044 249/14
3,863,885 A * 2/1975 McLoughlin ..... B28B 7/225 249/14
RE32,936 E * 5/1989 Smith ..... B28B 7/02 249/157
4,916,796 A 4/1990 Baumgartner
5,133,530 A 7/1992 Thoresen
5,511,347 A * 4/1996 Schwarz ..... B28B 7/225 52/182
6,860,460 B2 * 3/2005 Rellergert ..... E04G 13/06 249/14
6,959,521 B1 * 11/2005 Brooks ..... E04F 11/02 249/14
8,262,055 B2 9/2012 Costello et al.
8,376,309 B2 2/2013 Merriam
8,439,725 B2 5/2013 Bogl
8,865,034 B2 * 10/2014 Poulin ..... E04G 13/06 249/14
2006/0150556 A1 7/2006 Powell
2008/0115429 A1 * 5/2008 Zirbel ..... B28B 7/225 52/189
2009/0266969 A1 * 10/2009 Costello ..... B28B 7/225 249/14
2009/0266970 A1 * 10/2009 Sladojevic ..... B28B 7/225 249/14
2012/0261545 A1 10/2012 Morstatter

FOREIGN PATENT DOCUMENTS

FR 1321910 * 3/1963
FR 1321910 A * 3/1963 ..... B28B 7/225
FR 2546440 * 11/1984
JP 09123142 A * 5/1997 ..... B28B 7/225
WO WO-0056995 A1 * 9/2000 ..... E04F 11/025
WO WO-2007011127 A1 * 1/2007 ..... B28B 7/225

* cited by examiner

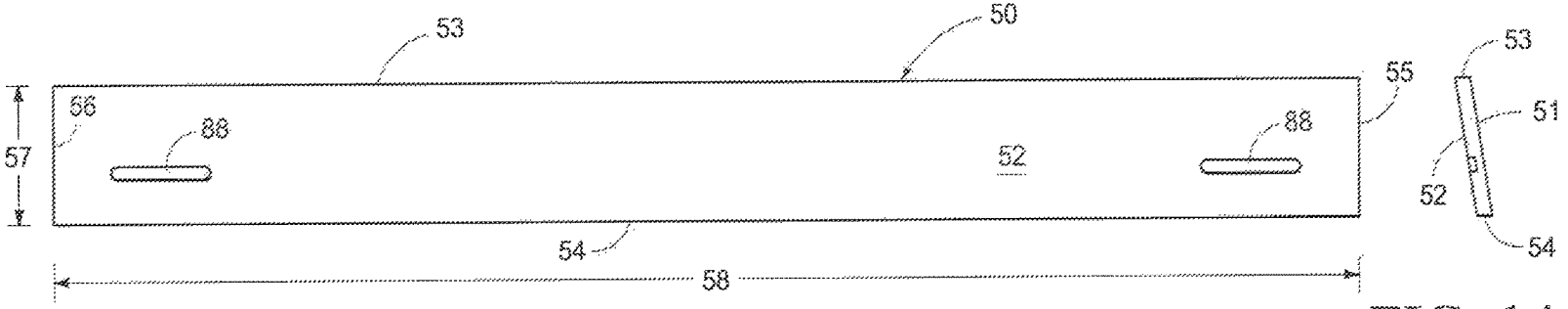
FIG. 14
FIG. 14A
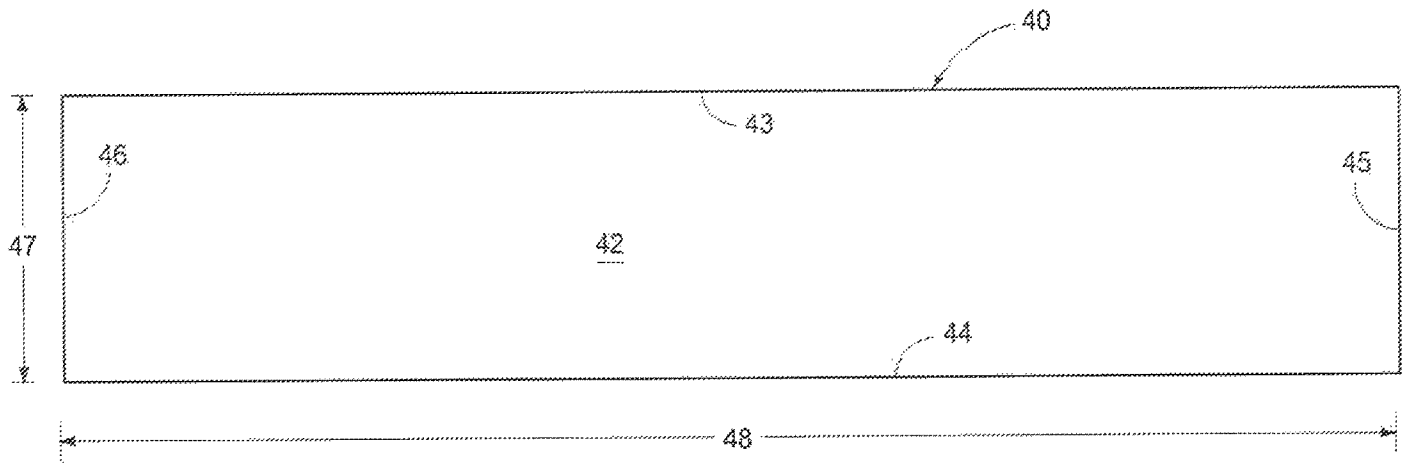
FIG. 15
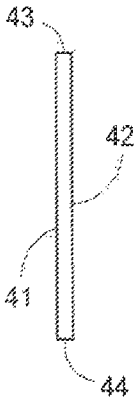
FIG. 15A

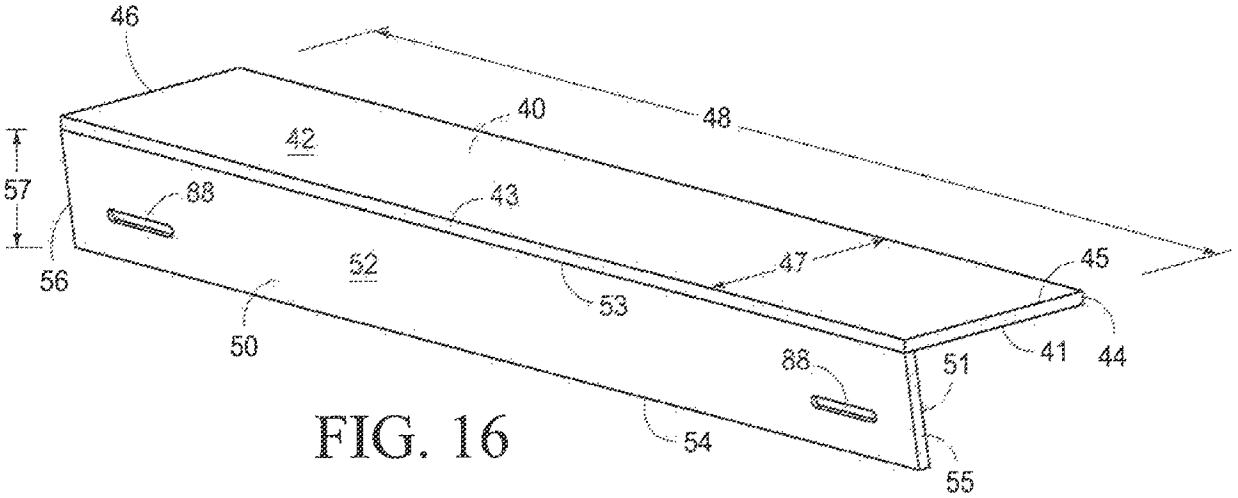
FIG. 16
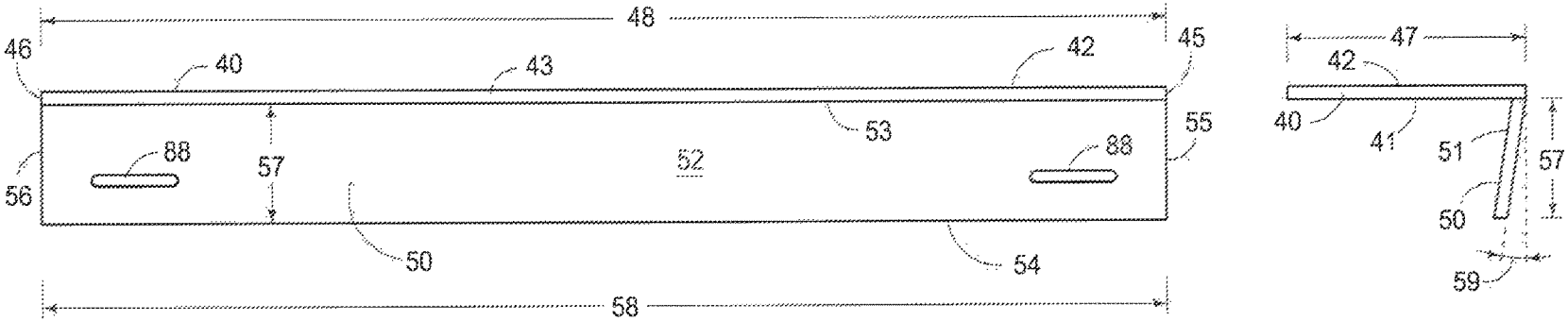
FIG. 17
FIG. 18

METHOD AND APPARATUS FOR PRODUCTION OF PRECISION PRECAST CONCRETE FLIGHTS OF STAIRS

TECHNICAL FIELD

There are no prior filed patent applications related hereto, filed in the United States nor in any foreign country.

FIELD OF INVENTION

The present invention relates to a method and apparatus for the production of a precision precast concrete flight of steps for installation in a multistory structure. More particularly, the present invention relates to a method and apparatus for production of stairways of concrete having dimensions to precisely extend between vertically adjacent floors of a multi-story structure. Such stairways may vary in overall width, riser count, and riser height.

BACKGROUND AND DESCRIPTION OF THE PRIOR ART

The terms "stringer" of stairs and the term "flight" of stairs are used interchangeably herein and both refer to a series of plural interconnected treads and risers (steps) that are placed to extend between vertically spaced apart levels of a structure to provide access and egress thereto. It is expressly noted herein that such "stringers" or "flights" of stairs need not be linear from end-to-end and may have curves, bends and shapes.

In the building of multi-floor structures, such as buildings, parking garages and other applications that require concrete steps it is common that the vertical distance between adjacent floors or levels is not consistent from floor to floor and in many cases the variance between floors may vary from fractions of an inch to several feet. The variance in vertical heights between the floors makes it difficult, and at times impossible, to use preformed standardized stringers of stairs to extend between the floors because it is imperative that all walking surfaces (including stair treads and landings) be parallel and that each tread is separated by a riser of identical height. Building codes typically limit height variance to ¼" between adjacent treads and ⅜" across an entire flight of consecutive steps. In instances when the variance between adjacent levels of the structure is small, such as less than ⅜ inch, a standardized stringer of stairs may be used, but will necessitate that the standardized stringer of stairs be both tipped a first direction to "stretch" to a greater vertical/horizontal distance or tipped a second direction to "shrink" to a lesser vertical/horizontal distance, and the landings at the upper and lower ends of the stringer of stairs thereafter need to be modified (ground) or (added to) to prevent gaps or raised edges that are tripping hazards. Although tipping a stringer of stairs is a common and an accepted practice to accommodate small vertical height variances in the vertically spaced levels, the tipping of the stringer of stairs has an additional negative effect of causing the stair treads and the upper and lower landings to not be horizontal which may cause the stringer of stairs to be noncompliant with building codes and increase risk of premises liability if a user were to trip or slip on the stairs. This may be an extreme risk in situations where the tipped stringers of stairs are used in unheated areas such as parking garages where moisture (rain/snow) may freeze to become ice.

In the construction a multi-floor structures, concrete stairways are a preferred means for providing non-mechanized access to the vertically spaced apart floors. Concrete is the preferred medium for building such stairways because it is strong, robust, durable, requires little maintenance, does not require use of separate fasteners, and is substantially "quieter" when being used by pedestrians ascending or descending the stairs. Further, concrete stairways may be integrated into the vertically spaced concrete decks of the structure. Unfortunately, concrete stairways are expensive because they are difficult to form and support during the construction process. Much of this cost is related to the labor necessary to create the forms and to provide support/shoring of the forms before and while the concrete is added to the forms. This is especially true if the stairway is external to the structure being built (such as a stairway immediately adjacent an exterior surface of the building).

Traditionally, when concrete, or similar formable or settable material is used to construct stairs, the stairs are either "cast-in-place", which is an expensive and time consuming process, or a stringer of stairs is "pre-cast" and the entire unit is set in place (installed) after fabrication.

Because concrete stairways are so difficult to construct and expensive to construct, designers, engineers and architects have compromised to provide some of the benefits of concrete stairways, while eliminating the excessive costs and difficulty of building/installing such stairways. The compromise has been steel stringers that may or may not have concrete treads. The steel/concrete combination stairways are less expensive, but come with drawbacks including excessive maintenance (such as painting) and corrosion treatment, steel stringers require separate fastening means which are typically mechanical (bolts/screws and anchors) and steel stairways are notoriously noisy when being used by pedestrian traffic.

The instant invention is an improvement in the process of forming a "pre-cast" concrete stringer of stairs. To form pre-cast stringers of stairs, a mold is made which is a negative of the "stringer" of stairs to be formed. Concrete is poured into the mold. The concrete is allowed to harden and the resulting stringer of stairs is harvested from the mold. Producing a dimensionally precise negative is very difficult and expensive, especially for single use applications.

In the world of pre-cast concrete products, everybody is striving for perfection, but such perfection is very difficult and expensive to obtain. Limitations in form material, manufacturing processes and human error cause variances upon variances that often cause the pre-cast component to be out of tolerance. On-site accommodations are not a favorable "fix" which is why pre-cast strings of stairs are not always the selection of first choice for engineers and architects.

The instant invention is directed to a method and apparatus for precision forming concrete into desired shapes. More specifically, the invention relates to a new and improved concrete forming device which can be assembled from precision pre-cut component parts, used to impart a precise desired shape to a flowable concrete mixture, removed when the concrete has hardened, disassembled and moved to a new location for use, or reused to form another stringer of stairs.

As is well known, freshly mixed concrete is flowable and must be retained in some type of forming device until it has hardened or "set" if it is to achieve the structural shape desired by an end user. A number of methods in the past have been employed to do this. Among available forms are wood forms, fiber forms, steel forms and fiberglass forms. Forms constructed from wood are reasonably inexpensive and relatively easy to work with. However, wood forms are porous and frequently have rough surfaces. These factors create a tendency for concrete to adhere to the forms, not only making it difficult to remove the forms after the concrete has set, but also making it hard to reuse the forms because portions of the surface often become partially coated with hardened cement. Further any surface texture of the forms, such as wood grain, cracks and the like are transferred to the hardened concrete which may cause negative aesthetic impressions. The need to frequently replace the forms and the effort required to disassemble and remove them, creates an appreciable expense over time. Steel forms generally comprise segments that are fabricated into predetermined units. Various problems with steel sectional forms include heavy weight, expensive production, difficult modification, the possibility of rusting steel, as well as the same tendency of concrete adherence that wooden forms have. Since steel forms are expensive they cannot be discarded, but must be thoroughly cleaned for reuse. This is a time consuming and costly process.

With Cast-in-Place concrete stairway systems, it has been common practice to construct formwork at a building site to receive the flowable concrete so as to form the stair structure. The formwork is typically made of wood and discarded once the concrete has been poured and has hardened. Wood formworks need to be braced, shored, and otherwise reinforced, thus, the building of formwork for concrete stairs requires much time, effort and materials which need to be repeated for each flight of stairs. Cast-in-Place concrete stairs are an expensive alternative, and because of that are often not used if other less expensive alternatives are available. The method and apparatus of the present invention can advantageously be used to build a formwork for a stringer of stairs of various sizes and shapes, with various structural and aesthetic elements. The typical stringer of stairs consists of a number of stairs and usually a landing or platform at the bottom and at the top. Each individual step consists of a tread and a riser. The "tread" is the part of the stair that is oriented generally horizontally and is stepped on by a user's foot. The "riser" is the part of the stair that is oriented generally vertically and connects each tread to an adjacent tread or a tread to an adjacent landing. Each tread may optionally carry a nosing which is positioned at a toe edge of the tread opposite the riser, along its width and is part of the tread that protrudes outwardly over the riser beneath.

Pursuant to industry building codes, each stair is required to have a "back set" from toe-to-toe which requires the riser to extend outwardly from the vertically adjacent below riser, or which requires the riser to be angulated relative to the interconnecting treads to provide the required "back set". Such angulation can significantly increase fabrication time because the angles are complex and must be precise to retain the flowable concrete within the form.

The overall height of a flight of stairs is called the Overall Rise (OR) and the overall length of the stairs is the Run-Length (RL). The rise height (RH) of each stair is measured from the top of one tread to the top of the next adjacent tread. The ratio of Rise Height (RH) to Run-Length (RL) is the pitch (P). The width (W) of each tread is measured from a first side edge to a second side edge of the same tread, and the tread depth (TD) is measured from the outer (front toe) edge of the nosing to the riser on the opposite (back) edge of the same tread, which is known as the "heel" of the stair. The Going (C) of a stair is the horizontal distance from the edge of the nosing of a tread to the edge of the nosing of the adjacent tread. The number of stairs in a flight of stairs is deduced by the number of risers present. The "throat" of the stair is the perpendicular distance from the back of the stringer to the "heel" of a stair. The "Throat" of the stair varies in thickness depending on the structural and/or aesthetic requirements of the stair.

One of the drawbacks to concrete flights of stairs is that they are difficult to properly produce, particularly if the stairway is wide, has additional aesthetic elements, is built "in-space" (as opposed to mid-slab or inside a core wall), or has a large number of risers. The concrete is initially in a flowable state and must be held in place by a form. If the stairway is large, the flowable concrete will present a substantial load on the form. Concrete will need to be vibrated during the pouring process to ensure the concrete is properly consolidated. The vibration presents an additional loading on the forms. As the concrete cures, the exposed surfaces of the concrete must be finished to provide the desired surface texture.

What is needed is an apparatus that can be used to form concrete flights of stairs that is reusable, one that can handle the loads associated with large stairs, one that facilitates the pouring and finishing of the stairs, and one that is easily configurable to handle a variety of different stair configurations.

The present invention relates to construction forms and more specifically to a method and apparatus for making precision forms for making precision concrete flights of stairs.

SUMMARY OF THE INVENTION

A precision cut form for precision forming a concrete stringer of stairs to provide access between vertically spaced apart levels of a structure, generally provides plural tread supports, each tread support having a first side and a second side, a first end and a second end, a bottom edge and a top edge, the top edge defining a plurality of intersecting tread cutouts and riser cutouts forming interior angles and exterior angles between the intersecting tread cutouts and riser cutouts, and each tread support further defining plural spacedly arrayed alignment dowel holes in the first and second sides.

Plural sideboards, each sideboard having a first side and a second side, a first end and a second end, a top edge, a bottom edge and a surface coating on at least one side, the surface coating to provide a desired final surface texture to the concrete stringer of stairs, each side board further carrying a tread support on the surface coated surface.

Plural stair risers, each stair riser having a front surface and a back surface, a top edge and a bottom edge, a first end and a second end and a surface coating on at least one surface, the surface coating to provide a desired final surface texture to the concrete stringer of stairs, the top edge and the bottom edge both having a precision cut angle thereon to provide for a riser back-set relative to an adjacent stair tread, and each stair riser having a height dimension between the top edge and the bottom edge that is substantially identical for all of the plurality of stair risers.

Plural stair treads, each stair tread having a top surface and a bottom surface, a first end and a second end, a toe edge and a heel edge and a surface coating on at least one surface, the surface coating to provide a desired final surface texture to the concrete stringer of stairs, the toe edge of each stair tread interconnected with the top edge of a stair riser to form a stair tread and stair riser combination having an interior angle between the stair tread and the stair riser that provides for a back set, and a tread depth dimension between the toe edge and the heel edge that is substantially identical for all of the plural stair treads.

An upper landing end plate communicating between two parallel spaced apart side boards proximate the second end portion of the sideboards, the upper landing end plate having a first side and a second side, a first end portion and a second end portion, a top edge and a bottom edge, the upper landing end plate further defining plural spacedly arrayed rebar holes therein communicating between the first side and the second side for reinforcing rebar to be positioned within the precision cut form to add structural rigidity to the produced concrete flight of stairs.

A lower landing end plate communicating between the two parallel spaced apart side boards proximate the first end portion of the sideboards, the lower landing end plate having a first side and a second side, a first end portion and a second end portion, a top edge and a bottom edge, the lower landing end plate defining plural spacedly arrayed rebar holes therein communicating between the first side and the second side for reinforcing rebar to be positioned within the precision cut form to add structural rigidity to the produced concrete flight of stairs.

An upper landing end cap having a top edge and a bottom edge, a first surface and a second surface, a first edge and a second edge, the upper landing end cap communicating between upper landing toes carried on the top edge of the two parallel spaced apart sideboards spacedly adjacent the second end portion of the side boards.

A lower landing end cap having a top edge and a bottom edge, a top surface and a bottom surface, a first edge and a second edge, the lower landing end cap communicating between landing slant bottoms defined in the first end portions of the two parallel spaced apart side boards to form a bottom surface of a lower landing of the concrete flight of stairs.

An upper landing tread having a top surface, a bottom surface, a first edge, a second edge, a first side and a second side, therein, the upper landing tread communicating between the two parallel spaced apart side boards to form an upper landing of the concrete stringer of stairs.

A lower landing tread having a top surface, a bottom surface a first edge, a second edge, a first side and a second side, the lower landing tread communicating between the two parallel spaced apart side boards to form a lower landing of the concrete stringer of stairs.

Plural center tread support spacers for positioning between two parallel spaced apart tread supports to form a center tread support, each of the plural center tread support spacers having a first side, a second side, a top edge, a bottom edge, a first end, a second end and a width dimension between the first end and the second end and each of the plural center tread support spacers further define plural alignment dowel holes in the first and second ends.

Plural alignment tabs for predetermined positioning on the bottom surface of the lower landing tread and on the bottom surface of the upper landing tread to facilitate automatic squaring and alignment of the precision cut form components, each alignment tab having a first side, a second side, a top edge, a bottom edge, a first end, a second end and a width dimension between the first end and the second end that is substantially identical to the width dimension of the plural center tread support spacers.

End plate locks for releasable attachment to the side boards immediately adjacent the upper landing end plate and immediately adjacent the lower landing end plate positionally secure the upper landing end plate and the lower landing end plate in a predetermined position relative to the adjacent side boards, and splice boards for releasably interconnecting adjacent side board portions adjacent tread support portions.

A further aspect of the instant method for forming a precision precast concrete flight of stairs to provide access between vertically spaced apart levels of a structure generally comprises the steps.

Calculating a number of stair risers and a number of stair treads to span a vertical distance and a horizontal distance between the vertically spaced apart levels of the structure while maintaining the stair treads in substantially parallel orientation relative to one another and parallel with the spaced apart levels.

Precision cutting form components comprising sideboards, tread supports, stair risers, stair treads, upper landing end plates, lower landing end plates, upper landing end caps, lower landing end caps, upper landing treads, lower landing treads, center tread support spacers, alignment tabs and end plate locks and precision drilling holes in the precision cut form components at predetermined positions to facilitate assembly and disassembly of the precision cut forms.

Interconnecting the tread supports to the sideboards.

Assembling the stair risers and the stair treads by interconnecting each stair riser with a stair tread along adjacent edge portions with a stair tread edge overlapping a stair riser edge.

Assembling a center tread support assembly from plural tread supports and positioning and interconnecting plural center tread support spacers between the plural tread supports so that the center tread support spacers extend transversely between the plural tread supports.

Assembling an upper landing assembly with the upper landing tread, the upper landing end plate and a stair riser and attaching an alignment tab to a bottom surface of the upper landing tread for aligning and squaring the upper landing assembly within the assembled center tread support.

Assembling a lower landing assembly with the lower landing tread and the lower landing end plate and attaching an alignment tab to a bottom surface of the lower landing tread for aligning and squaring the lower landing assembly within the assembled center tread support.

Positioning the assembled center tread support assembly on a horizontal supporting surface and positioning the assembled upper landing assembly within the assembled center tread support assembly, at an upper end portion thereof, and engaging the alignment tab carried on the bottom surface of the upper landing tread within the assembled center tread support assembly to square and align the upper landing assembly within the assembled center tread support.

Positioning the assembled stair risers and stair treads within the assembled center tread support beginning immediately adjacent the positioned upper landing assembly and continuing the positioning of the assembled stair risers and stair treads to an end of the assembled center tread support opposite the positioned upper landing assembly.

Positioning the assembled lower landing assembly within the assembled center tread support assembly, at the end opposite the upper landing assembly and engaging the alignment tab carried on the bottom surface of the lower landing tread within the assembled center tread support assembly to square and align the treads, risers and landing assemblies within the center tread support.

Positioning and interconnecting with fasteners the sideboards to each side of the upper landing assembly, the stair risers and stair treads and the lower landing assembly positioned within the center tread support assembly, the fasteners extending through the precision drilled holes.

Positioning, aligning and interconnecting with fasteners an upper end plate cap adjacent the upper landing assembly, the upper end plate cap extending transversely between the spaced apart side boards and interconnecting with an upper landing toe carried on each side board.

Positioning, aligning and interconnecting with fasteners a lower end plate cap adjacent the lower landing assembly, the lower end plate cap extending transversely between the spaced apart side boards and interconnecting with a landing slant bottom defined in each side board at an end portion opposite the upper landing assembly.

Positioning and interconnecting with fasteners an end plate lock on each sideboard immediately adjacent the upper landing end plate to positionally secure the landing end plates relative to the sideboards.

Installing reinforcing rebar members within the assembled form to provide structural rigidity to the precision precast concrete flight of stairs.

Adding flowable concrete into the assembled form, and allowing the flowable concrete to cure/harden.

Removing the end plates and the end plate caps and removing the sideboards from the hardened precast concrete flight of stairs by removing the fasteners.

Removing the cured/hardened precision precast concrete flight of stairs; and reassembling and reusing the precision precast concrete flight of stair form for another precision precast concrete flight of stairs.

A further aspect of the method for forming a precision precast concrete flight of stairs comprises the step of positioning inlays at predetermined positions within the assembled form to generate desirable features in the surface of the hardened concrete.

A further aspect of the method for forming a precision precast concrete flight of stairs comprises the step of positioning a lifting bar sleeve/pipe within the assembled form to extend generally transversely between the spaced apart sideboards at a generally medial position between the upper landing assembly and the lower landing assembly to provide a lifting and manipulation point for the produced concrete stringer of stairs.

A still further aspect of the method for forming a precision precast concrete flight of stairs to provide access between vertically spaced apart levels of a structure, comprises the steps:

Determining a substantially exact vertical distance between a predetermined lower level landing position and a predetermined vertically adjacent upper level landing position.

Determining a substantially exact horizontal distance between the predetermined lower level landing position and the predetermined vertically adjacent upper level landing position.

Calculating a number of equally dimensioned stair risers and a number of equally dimensioned stair treads to span the substantially exact vertical distance and the substantially exact horizontal distance between the lower level landing position and the vertically adjacent upper level landing position while maintaining the stair treads and the upper level landing and the lower level landing in substantially parallel orientation relative to one another.

Precision cutting from cellulosic material form components, for forming the precision precast concrete flight of stairs, and precision drilling holes therein at predetermined positions to facilitate assembly and disassembly of the precision cut form, the precision cut form components comprising sideboards, tread supports, stair risers, stair treads, upper landing end plates, lower landing end plates, upper landing end caps, lower landing end caps, upper landing treads, lower landing treads, center tread support spacers, alignment tabs and end plate locks.

Interconnecting the tread supports to the sideboards.

Assembling the stair risers and the stair treads by interconnecting each stair riser with a stair tread along adjacent edge portions with a stair tread edge overlapping a stair riser edge.

Assembling a center tread support assembly from plural tread supports and positioning and interconnecting plural center tread support spacers between the plural tread supports so that the center tread support spacers extend transversely between the plural tread supports.

Assembling an upper landing assembly with the upper landing tread, the upper landing end plate and a stair riser and attaching an alignment tab to a bottom surface of the upper landing tread for aligning and squaring the upper landing assembly within the assembled center tread support.

Assembling a lower landing assembly with the lower landing tread and the lower landing end plate and attaching an alignment tab to a bottom surface of the lower landing tread for aligning and squaring the lower landing assembly within the assembled center tread support.

Positioning the assembled center tread support assembly on a horizontal supporting surface and positioning the assembled upper landing assembly within the assembled center tread support assembly, at an upper end portion thereof, and engaging the alignment tab carried on the bottom surface of the upper landing tread within the assembled center tread support assembly to square and align the upper landing assembly within the assembled center tread support.

Positioning the assembled stair risers and stair treads within the assembled center tread support beginning immediately adjacent the positioned upper landing assembly and continuing the positioning of the assembled stair risers and stair treads to an end of the assembled center tread support opposite the positioned upper landing assembly.

Positioning the assembled lower landing assembly within the assembled center tread support assembly, at the end opposite the upper landing assembly and engaging the alignment tab carried on the bottom surface of the lower landing tread within the assembled center tread support assembly to square and align the treads, risers and landing assemblies within the center tread support.

Positioning and interconnecting with fasteners the sideboards to each side of the upper landing assembly, the stair risers and stair treads and the lower landing assembly positioned within the center tread support assembly, the fasteners extending through the precision drilled holes.

Positioning, aligning and interconnecting with fasteners an upper end plate cap adjacent the upper landing assembly, the upper end plate cap extending transversely between the spaced apart side boards and interconnecting with an upper landing toe carried on each side board.

Positioning, aligning and interconnecting with fasteners a lower end plate cap adjacent the lower landing assembly, the lower end plate cap extending transversely between the spaced apart side boards and interconnecting with a landing slant bottom defined in each side board at an end portion opposite the upper landing assembly.

Positioning and interconnecting with fasteners an end plate lock on each sideboard immediately adjacent the upper landing end plate to positionally secure the upper landing end plate relative to the sideboards.

Adding reinforcing rebar members within the assembled form to provide structural rigidity to the precision precast concrete flight of stairs.

Adding flowable concrete into the assembled form, and allowing the flowable concrete to cure/harden.

Removing the end plates and the end plate caps and removing the sideboards from the hardened precast concrete flight of stairs by removing the fasteners.

Removing the cured/hardened precision precast concrete flight of stairs; and reassembling and reusing the precision precast concrete flight of stair form for another precision precast concrete flight of stairs.

BRIEF DESCRIPTION OF THE DRAWINGS

FIG. 14 is an orthographic back view of a stair riser.

FIG. 14A is an orthographic end view of the stair riser of FIG. 14 showing the angled cuts at the upper and lower edges to facilitate a riser back set.

FIG. 15 is an orthographic plan view of a stair tread.

FIG. 15A is an orthographic end view of the stair tread of FIG. 15.

FIG. 16 is an upside down isometric back, bottom and end view of an assembled tread riser combination forming a step assembly.

FIG. 17 is an upside down, orthographic back view of the step assembly of FIG. 16.

FIG. 18 is an orthographic end view of the step assembly of FIG. 16, showing the angulation of the riser relative to the tread to facilitate the riser back set.

DETAILED WRITTEN DESCRIPTION

Figure 1:
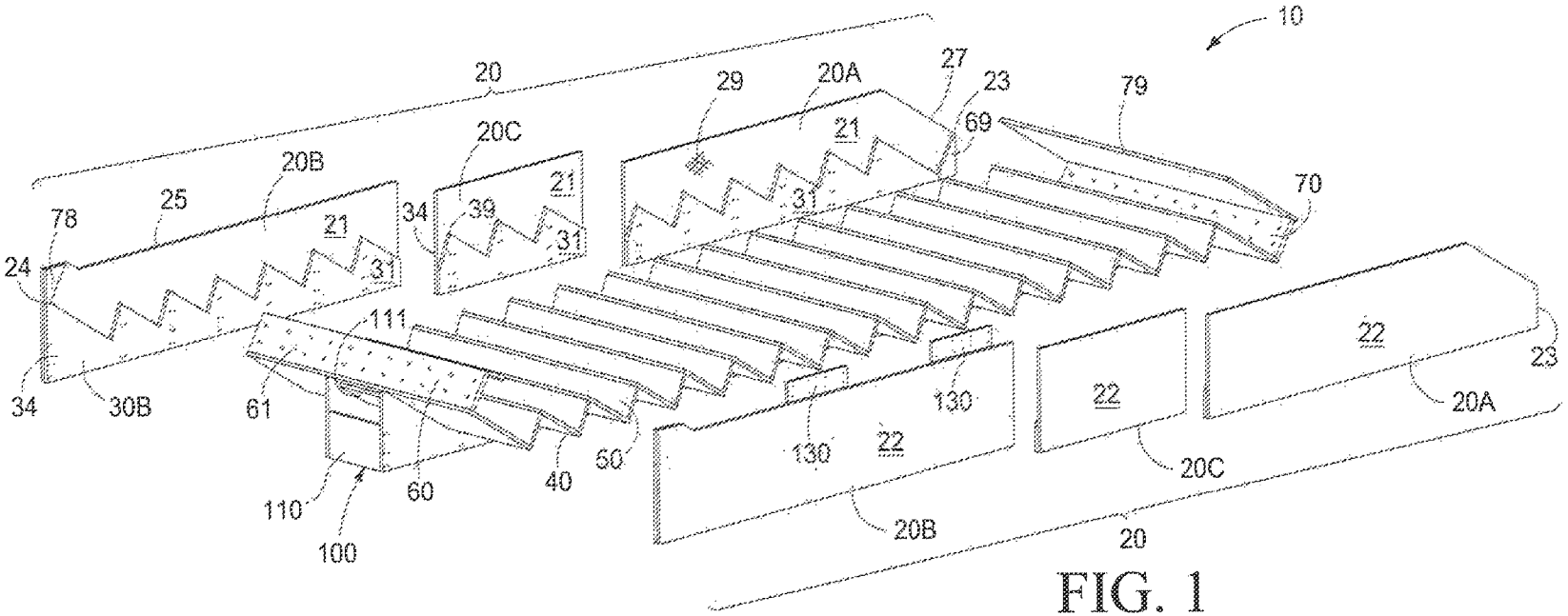
FIG. 1 is an exploded isometric side, upper landing end and top view of my precision cut form for precision casting concrete flights of stairs.

My method and apparatus for production of precision precast concrete flights of stairs generally provides precision cut side boards 20, tread supports 30, treads 40, risers 50, an upper landing assembly 80 and a lower landing assembly 90.

As can be seen in FIG. 1, each precision cut form (hereinafter designated generally by the numeral 10) has two spaced apart side boards 20 each carrying tread supports 30. The sideboards 20 and tread supports 30 are identical mirror images of one another. Because of this similarity only one side board 20 and one tread support 30 will be described in detail herein.

In use, the side boards 20 are parallel and spaced apart from one another so that a plurality of tread 40 and riser 50 combinations extend transversely therebetween. The length of any produced concrete stringer of stairs (not shown) may be adjusted by adding an intermediate portion 20C of a side board 20 and a tread support 30C between a first lower portion 20A and a second upper portion 20B. (See FIG. 1). Small stringers may not require a separate "lower end portion" 20A and a separate "upper end portion" 20B, but may be constructed of a single piece with an upper and lower end portion contained on the same sideboard.

Figure 4:
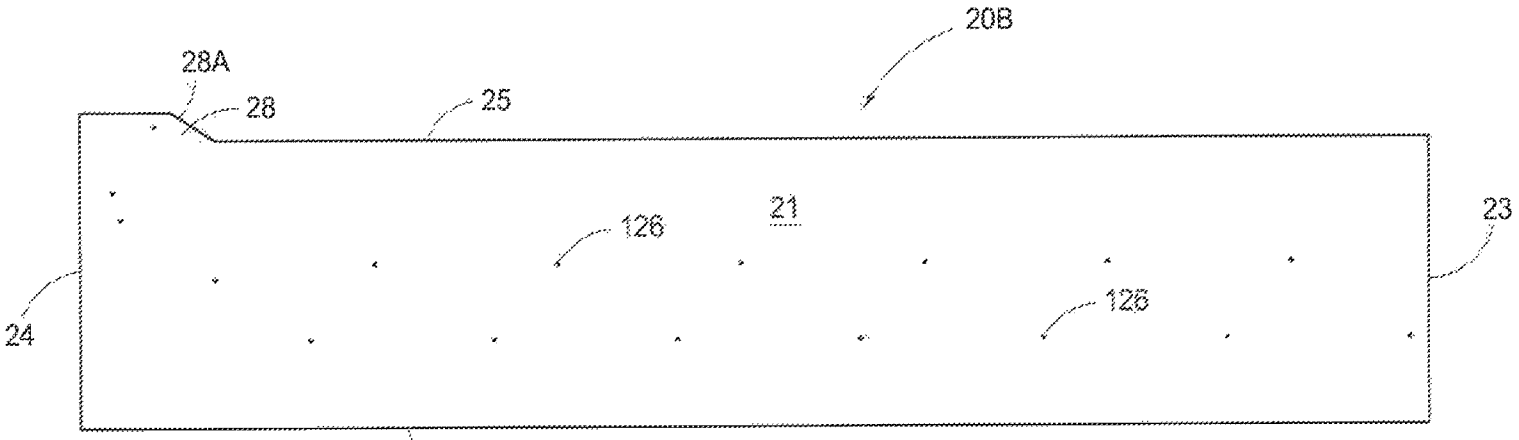
FIG. 4 is an orthographic side view of a second upper end portion side board showing the plurality of predrilled spacedly arrayed holes for threaded fasteners to assist in attachment of the assembled side boards to the tread/riser combinations.
Figure 5:
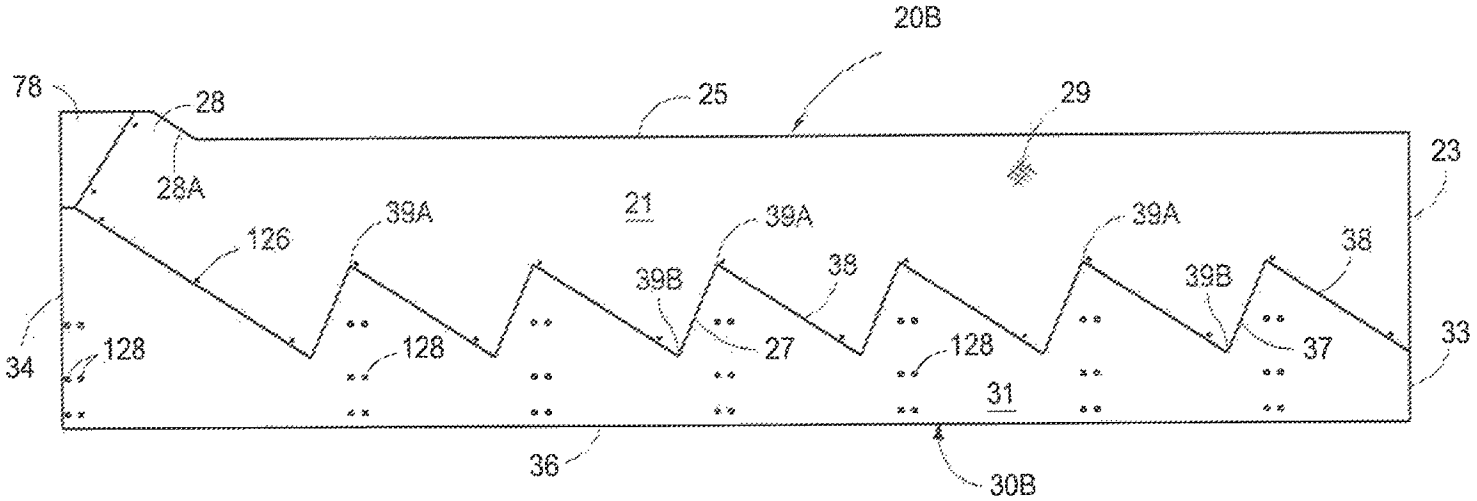
FIG. 5 is an orthographic side view of the second upper portion tread support of FIG. 3 fastened to the second upper position side board of FIG. 4 showing placement of the upper endplate lock.
Figure 29:
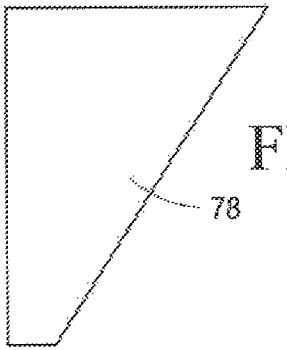
FIG. 29 is an orthographic side view of the upper endplate lock.

Each side board 20, and each portion 20A, 20B and 20C thereof, has a first side 21, an opposing second side 22, a first end portion 23, a second end portion 24, a top edge 25 and a bottom edge 26. The side board portions 20A, 20B and 20C are configured to be joined together end 23 to end 24 to accommodate variable lengths and to form a complete side board 20. A landing slant bottom 27 joins the top edge 25 and the first end portion 23 of side board 20A. The landing slant bottom 27 provides an angular surface upon which a lower endplate cap 79 is carried, so as to form a bottom surface of the lower landing assembly 90. An upper landing toe 28 (FIGS. 4 and 5) is carried on the top edge 25 proximate to the second end 24 of side board 20B. The upper landing toe 28 provides a mounting location for an upper endplate lock 78 (FIG. 29) that secures an upper landing endplate 60 to the precision cut form 10.

At least one side 21, 22 of each side board 20, of each tread 40 and of each riser 50 has a coating 29 thereon that prevents sticking and adherence of concrete 122 (not shown) as the concrete hardens. The coating 29 increases the longevity and usefulness of the form components and provides a desirable surface to the finished hardened concrete. Such coating 29 may be integral with the material used to create the side boards 20, treads 40 and risers 50, such as but not limited to High Density Overlay (HDO) plywood, or the coating 29 may be applied to the forms 10 by a user. It is also contemplated that inlays (not shown) that have desirable surface textures may also be added to the forms 10 and to the various components including, but not limited to, the stair treads 40 and stair risers 50 to create desired surface textures on the hardened concrete surface.

Figure 3:
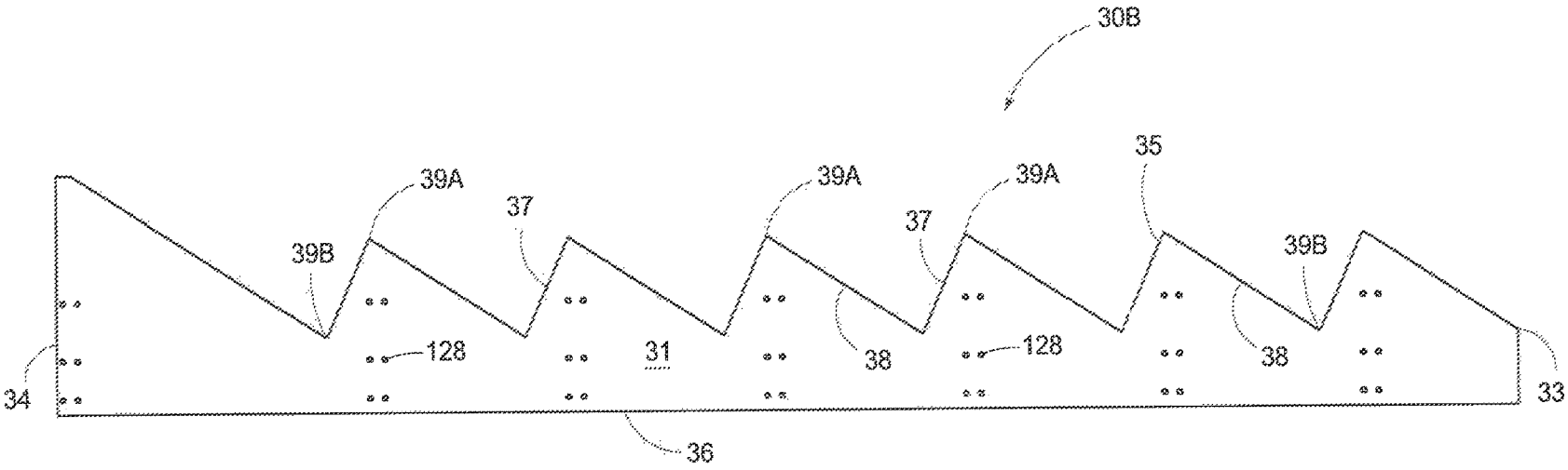
FIG. 3 is an orthographic side view of a second upper end portion of a tread support showing the tread and riser cutouts and the plurality of predrilled spacedly arrayed holes for alignment dowels.
Figure 6:
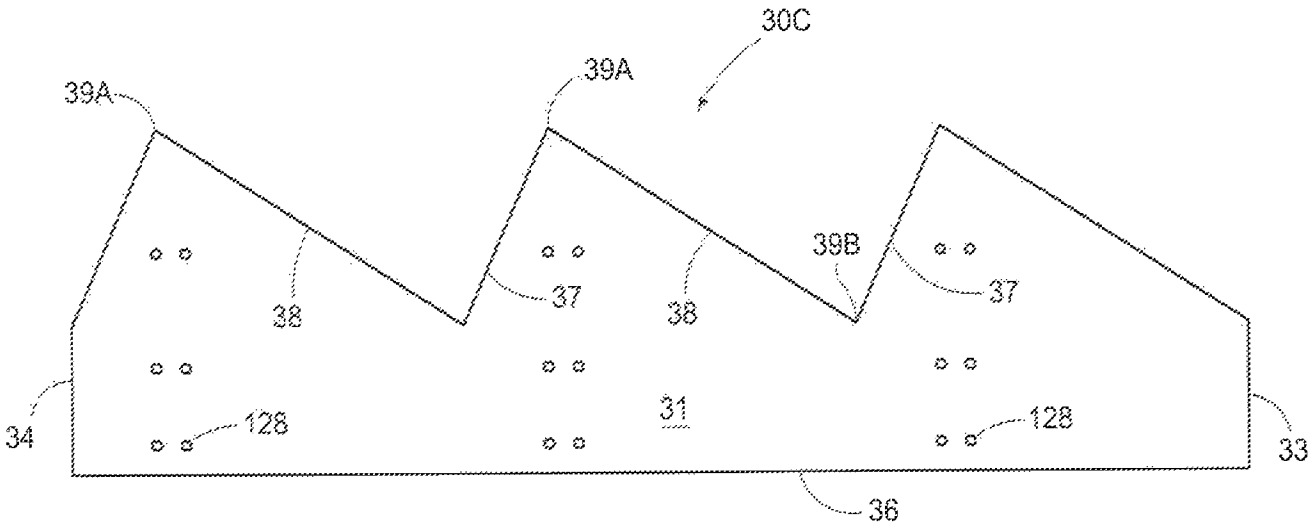
FIG. 6 is an orthographic side view of an optional intermediate portion of a tread support showing the tread and riser cutouts and the plurality of predrilled spacedly arrayed holes for alignment dowels.
Figure 7:
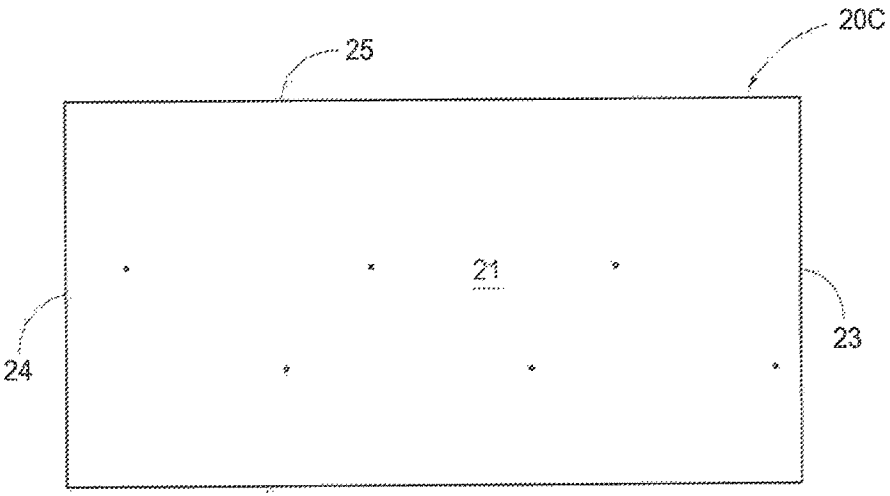
FIG. 7 is an orthographic side view of an optional intermediate portion of a side board showing the plurality of spacedly arrayed predrilled holes for threaded fasteners.
Figure 8:
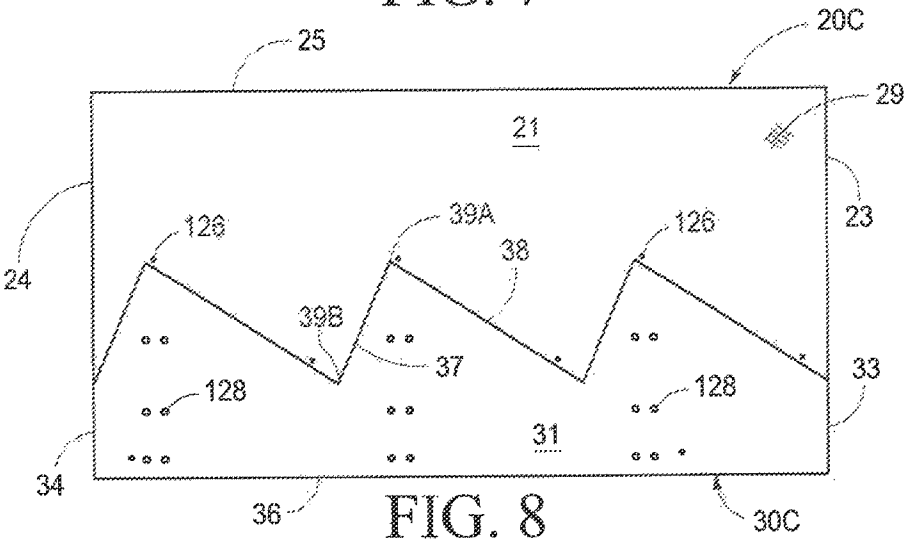
FIG. 8 is an orthographic side view of the optional intermediate portion of the tread support of FIG. 6 fastened to the optional intermediate position of the side board of FIG. 7.
Figure 9:
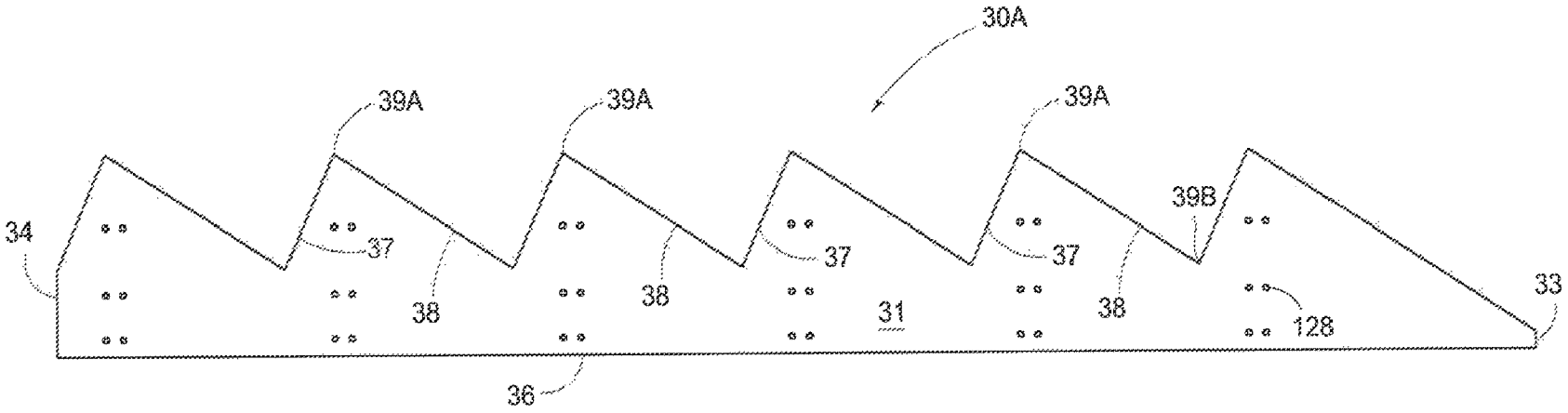
FIG. 9 is an orthographic side view of a first lower end portion of a tread support showing the tread and riser cutouts and the plurality of predrilled spacedly arrayed holes for alignment dowels.
Figure 10:
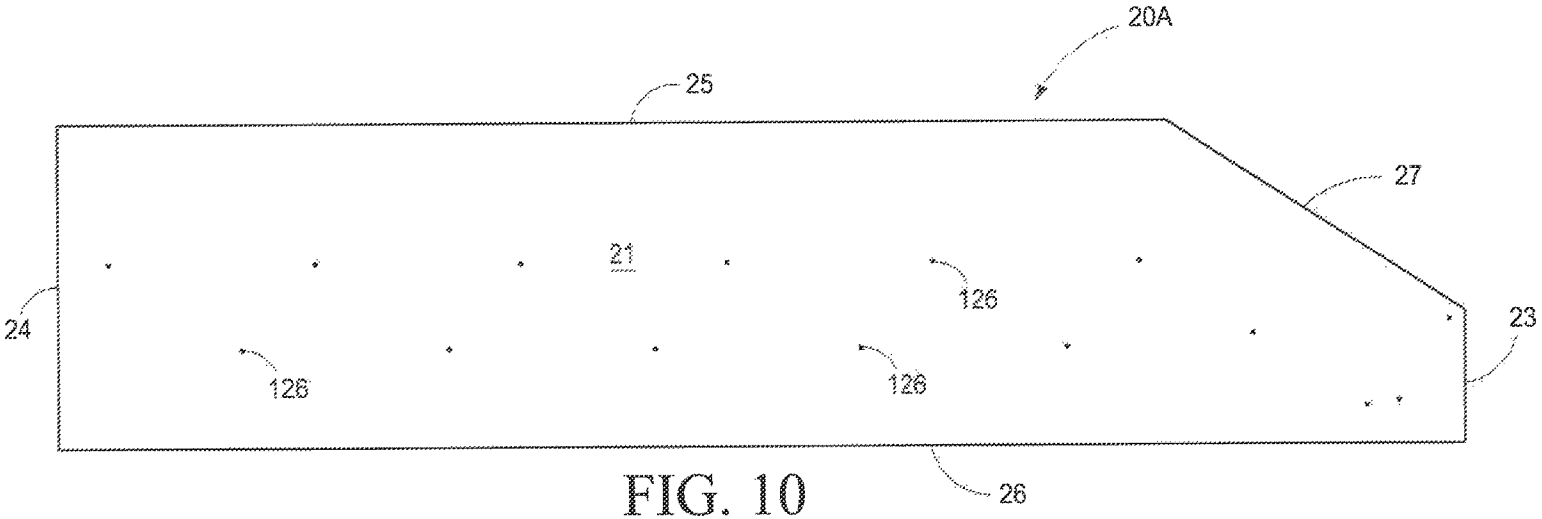
FIG. 10 is an orthographic side view of a first lower end portion side board showing the landing slant bottom and showing the plurality of spacedly arrayed predrilled holes for threaded fasteners.
Figure 11:
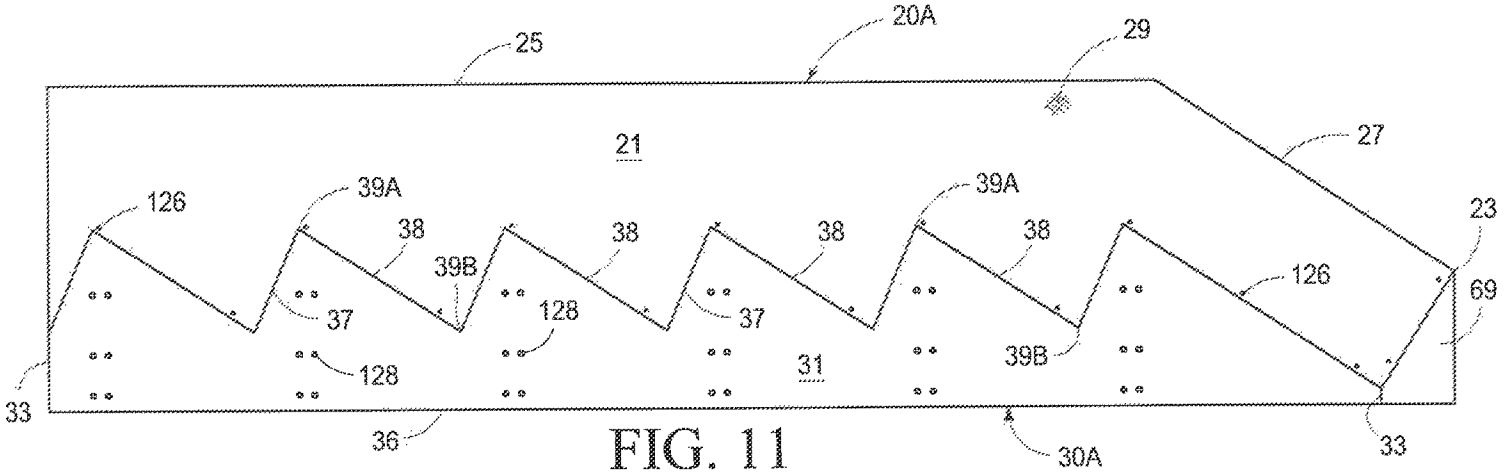
FIG. 11 is an orthographic side view of the first lower portion tread support of FIG. 9 fastened to the first lower portion side board of FIG. 10 showing the lower endplate lock secured to the side board.

Each side board portion 20A, 20B, 20C carries a corresponding portion of a tread support 30A, 30B, 30C. Each tread support 30 (FIGS. 3, 6, 9) has a first side 31, a second side 32, a first end portion 33, a second end portion 34, a bottom edge 36 and a top edge 35 opposite the bottom edge 36 that defines riser cutouts 37, tread cutouts 38, exterior corners 39A and interior corners 39B. The exterior corners 39A and the interior corners 39B communicate between each riser cutout 37 and its adjacent tread cutout 38. Each tread support 30 further defines a plurality of predrilled spacedly arrayed alignment dowel holes 128 therein to provide for ease of assembly of the form 10.

Tread support portions 30A, 30B and 30C (FIGS. 3, 6 and 9) are attached to the corresponding side board portions 20A, 20B and 20C to comprise assembled side boards 20. (FIGS. 1, 5, 8 and 11).

Figure 33:
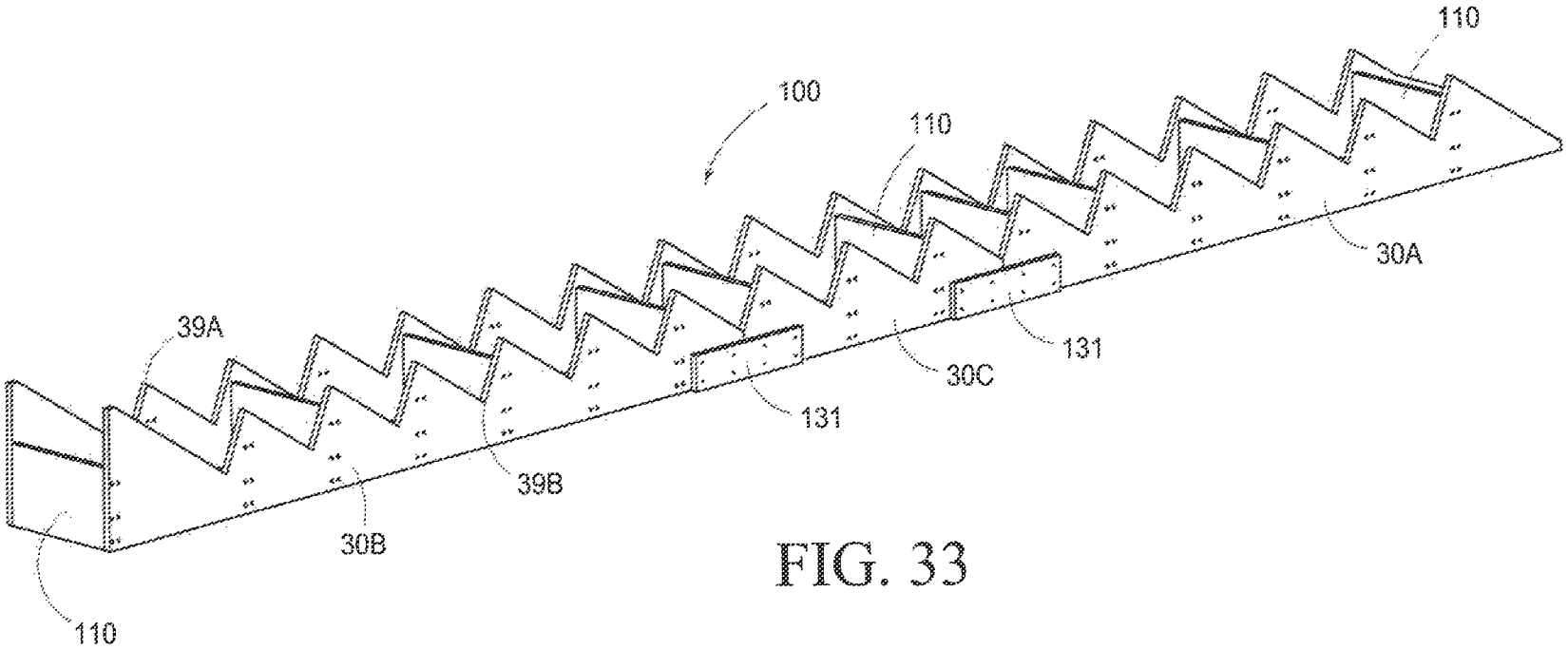
FIG. 33 is an isometric top, upper landing end and side view of an assembled center tread support having two tread risers each with upper, lower and medial portions, and plural center tread support spacers extending traversely therebetween which are attached using alignment dowels.

Center tread support 100 assembly (FIG. 33) is comprised of preferably at least two (and optionally more if tread width 48 is large) parallel spaced apart tread supports 30 each having a number of tread cutouts 38 and riser cutouts 37 to match the number of tread cutouts 38 and riser cutouts 37 defined in the tread supports 30 carried by the assembled sideboards 20. If plural tread support portions 30A, 30B and 30C are used in creation of a form 10, the tread support portions 30A, 30B and 30C are interconnected to one another using splice plates 130. The center tread support 100 (FIG. 33) provides rigidity, strength and squareness to the assembled form 10. The parallel spaced apart tread supports 30 forming the center tread support 100 are interconnected to one another using plural center tread support spacers 110 (FIGS. 31, 33) that extend transversely between the parallel tread supports 30 and a plurality of alignment dowels (not shown) that releasably engage in the plurality of predrilled spacedly arrayed alignment dowel holes 128 defined in the first and second sides 31, 32 respectively of the tread supports 30 and in opposing edge portions of the center tread support spacers 110.

Identicality and precision of the various components is essential to maintain the squareness of the form 10 and also its ease of assembly and disassembly. Such identicality and precision is preferably achieved by forming the various components using computer aided design and manufacture although other known processes, such as skilled artisans may likewise be used. One benefit of such precision and identicality is interchangeability of similar use components. For example, one form 10 may be used to form a precision stringer of concrete stairs with ten risers, and immediately thereafter the same form 10 may be used to create a precision stringer having six risers solely by altering the number of tread 40 and riser 50 combinations and moving the location of the upper landing assembly 80, and/or the lower landing assembly 90 so that the desired distance between the two landing assemblies 80, 90 is achieved. As noted previously, the precision cutting of the components could possibly be achieved by skilled artisans in the field of formworks, but such skilled artisans are expensive and skilled artisans require time to produce such precision forms which are two of the various drawbacks to currently available forms that are resolved by the instant invention. Computer aided design and manufacture has the added benefit of maximizing material and minimizing material waste.

Plural assembled tread 40 and riser 50 combinations (FIG. 16) extend traversely between the two assembled spaced apart side boards 20, and are supported at their opposing end portions by the tread supports 30 carried by the sideboards 20, and immediately by the center tread support assembly 100. Each tread 40 (FIGS. 15, 16) has a top surface 41, a bottom surface 42, a toe edge 43, a heel edge 44, a first end 45, a second end 46 and has a tread depth 47 extending between the toe edge 43 and the heel edge 44 and also has a tread width 48 extending between the first end 45 and the second end 46.

Each riser 50 (FIGS. 14, 14A, 16) has a front surface 51, a back surface 52, a top edge 53, a bottom edge 54, a first end 55, and a second end 56. A riser height 57 is defined between the top edge 53 and the bottom edge 54, and the riser width 58 is defined between the first end 55 and the second end 56 and is substantially identical to the tread width 48. A hand hold 88 may be milled into the back surface 52 of each riser 50 to assist in moving and manipulating the riser 50 and/or tread 40 riser 50 combination during use. The milled handholds 88 do not extend through the riser 50 to the first side 51 thereof.

A tread 40 and riser 50 combination (FIG. 16) creates a single step. Each tread 40 is interconnected with a riser 50 with the toe edge 43 of the tread 40 aligned with and overlapping the top edge 53 of each riser 50. (See FIG. 18). The first end 45 of each tread 40 is aligned with the first end 55 of each riser 50 and similarly, the second end 46 of each tread 40 is aligned with the second end 56 of each riser 50. As shown in FIG. 18, the interconnection of each tread 40 with each riser 50 is not a right angle, but rather is angulated to provide a required "back set" 59 which is commonly required by building codes. Because the interconnection of each tread 40 to each riser 50 is not a right angle (FIG. 18), it is therefore necessary that the tread supports 30 and center tread support 100 similarly be manufactured with exterior corners 39A and interior corners 39B that are identical to the angle 59 formed between each tread 40 and each riser 50.

In the casting of concrete stringers of stairs that have a large tread width 48, additional center tread supports 100 may be used by placing an additional center tread support (not shown) spacedly adjacent and parallel to the assembled center tread support 100 and fastening the additional center tread support (not shown) thereto using plural center support spacers 110 and plural alignment dowels (not shown) that engage with the plurality of spacedly arrayed predrilled holes 128.

Figure 2:
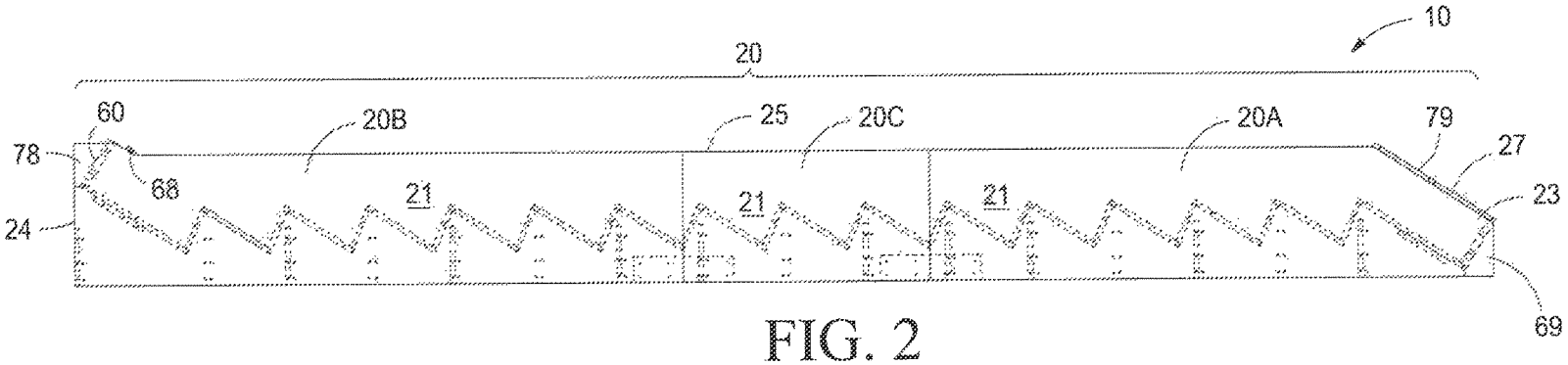
FIG. 2 is an orthographic side phantom view of the form of FIG. 1.
Figure 32:
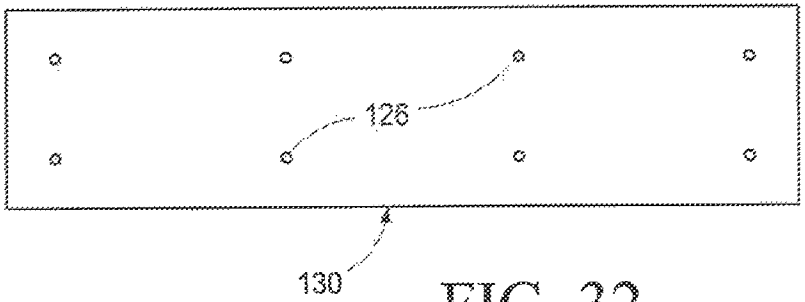
FIG. 32 is an orthographic side view of a splice plate showing a plurality of predrilled spacedly arrayed holes for threaded fasteners.

A splice plate 130 (FIGS. 1, 32, 33) may be used to interconnect the side board 20 portions A, B, C as well as center tread support 100 portions A, B, C using threaded fasteners (not shown). As shown in FIG. 2, the splice plates 130, if used, are placed vertically below the tread 40 and riser 50 combinations so as to not leave an imprint in the stair stringer produced by the form 10.

Figure 21:
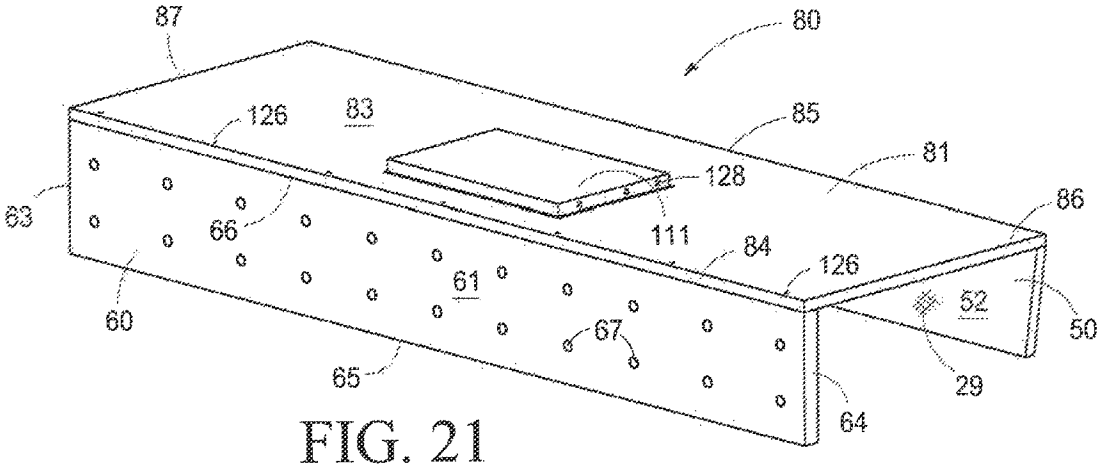
FIG. 21 is an upside down isometric front, bottom and edge view of the assembled upper landing assembly showing placement of the alignment tab on the bottom of the upper landing tread, the upper landing endplate and riser.
Figure 23:
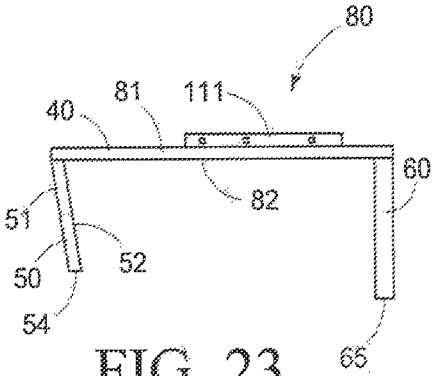
FIG. 23 is an orthographic end view of the assembled upper landing assembly of FIG. 21.
Figure 22:
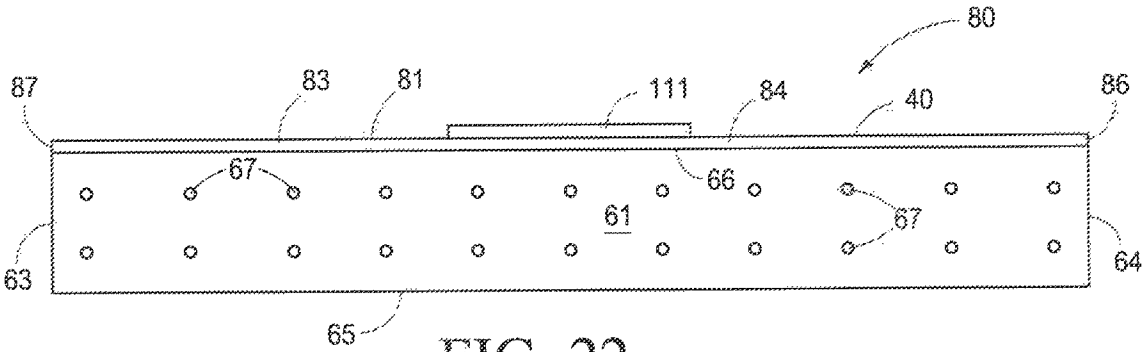
FIG. 22 is an orthographic front view of the assembled upper landing assembly of FIG. 21.
Figure 31:
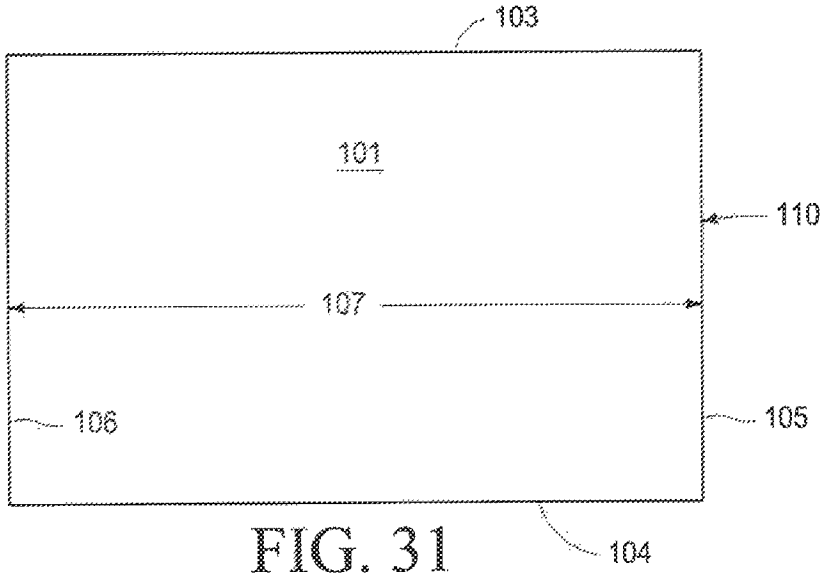
FIG. 31 is an orthographic plan view of the center support spacer which has the same dimensions as the upper and lower landing alignment tabs.

The upper landing assembly 80 (FIG. 21) has an upper landing tread 81, and upper landing endplate 60, a riser 50 and an alignment tab 111 carried on the bottom surface 83 of the upper landing tread 81 so as to engage with and squarely align the upper landing assembly 80 with the center tread support 100. A side to side width dimension 112 of the alignment tab 111 is substantially exactly the same as a side to side width dimension 107 of center tread support spacer 110. (FIG. 31). The substantially exactly the same side to side width dimensions 112, 107 respectively of the alignment tab 111 and the center support spacer 110 ensure secure engagement of the upper landing assembly 80 within the center tread support 100 and automatically "squares" the form 10 when the upper landing assembly 80 is engaged with the center tread support 100.

Figure 12:
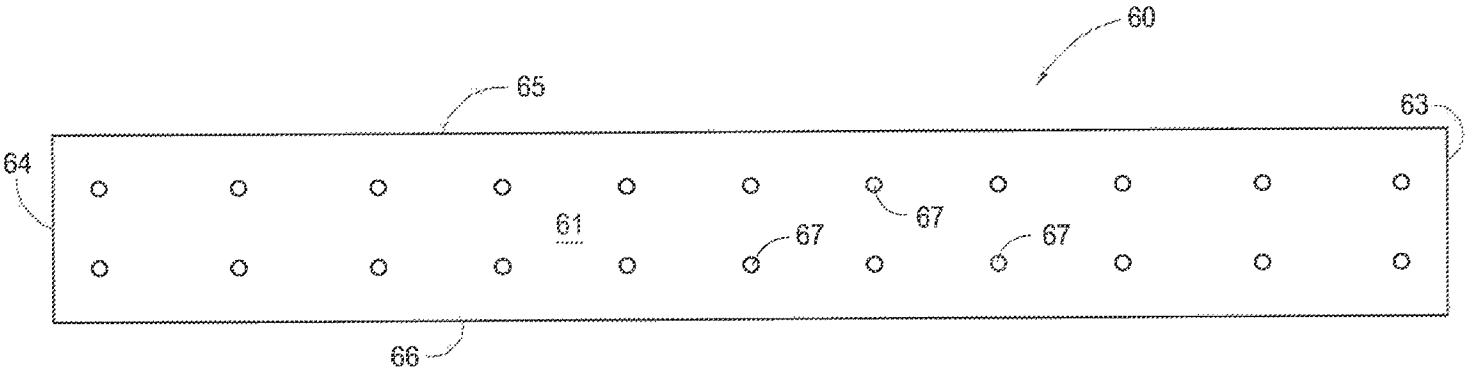
FIG. 12 is an orthographic view of the upper landing endplate showing the plurality of spacedly arrayed holes defined therein for the reinforcing rebar.
Figure 12A:
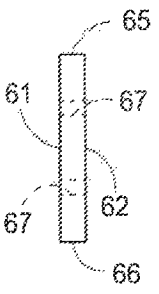
FIG. 12A is an orthographic end view of the upper landing endplate of FIG. 12.

The upper landing tread 81 need not have the same dimensions as step treads 40 so as to facilitate interconnection with an adjacent floor/level of the building (not shown). The upper landing tread 81 is generally rectilinear having a top surface 82, a bottom surface 83, a first edge 84, a second edge 85, a first side 86 and a second side 87. Holes 126 are predrilled therein for attachment of the upper landing endplate 60. The upper landing endplate 60 (FIG. 12) is generally rectilinear in configuration having a first side 61, a second side 62, a first end portion 63, a second end portion 64, a top edge 65, a bottom edge 66 and defines a plurality of spacedly arrayed rebar holes 67 communicating between the first side 61 and the second side 62. Precise placement and number of the rebar holes 67 is determined during the engineering of the form 10. The number and placement of the rebar holes 67 in the upper landing end plate 60 is dictated by the ultimate finished dimensions of the concrete stringer of stairs and the structural requirements thereof. Longer and wider stringers require added strengthening rebar (not shown) and therefor additional rebar holes 67. The upper landing endplate 60 is attached to first edge 84 of the upper landing tread 81, and the riser 50 is attached to the second edge 85 of the upper landing tread 81.

An upper end plate lock 78, (FIG. 1, 29) fastened to the side board 20B on the upper landing toe 28 adjacent to the top edge 25, positionally secures the upper landing assembly 80 and endplate 60. It has been determined that due to the ultra-tight tolerances used in creating the precision precut forms, that without the removability and later installation of the upper endplate lock 78, it is not feasible to install the sideboard 20B and its tread support 30B onto the assembled upper landing assembly 80 without damaging the components which results in an inferior finished end product stringer of concrete stairs. The upper end plate lock 78, and its removability is a unique and novel aspect of the invention.

Figure 26:
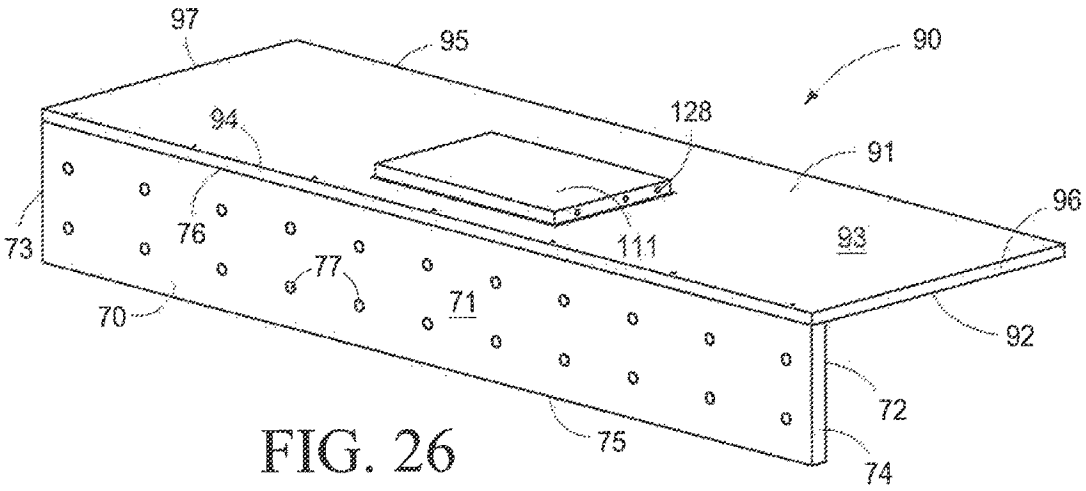
FIG. 26 is an upside down isometric front, bottom and edge view of the assembled lower landing assembly showing placement of the alignment tab on the bottom of the lower landing tread and the lower landing endplate.
Figure 28:
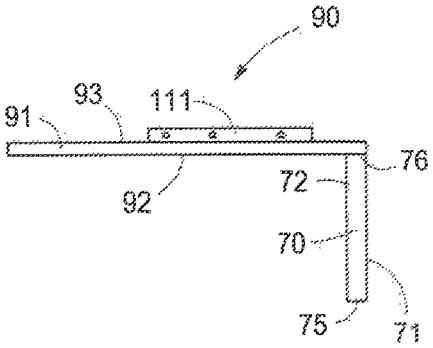
FIG. 28 is an orthographic edge view of the assembled lower landing assembly of FIG. 26.
Figure 27:
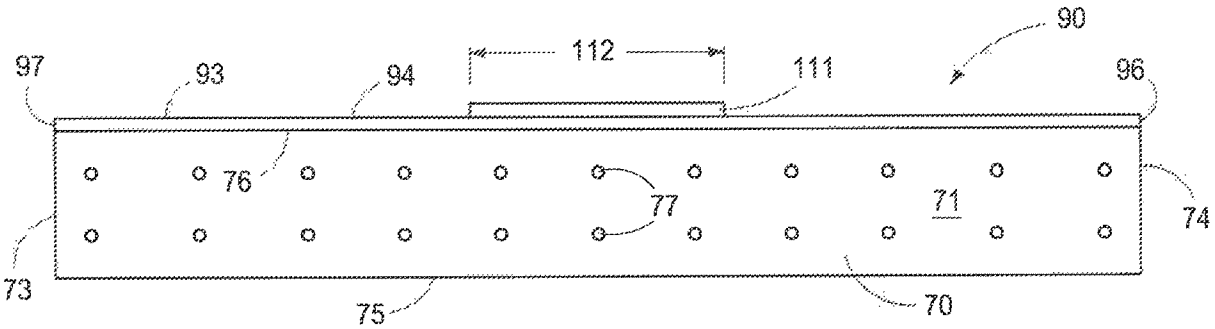
FIG. 27 is an orthographic front view of the assembled lower landing assembly of FIG. 26.

Lower landing assembly 90 (FIG. 26) has a lower landing tread 91, a lower landing end plate 70 and an alignment tab 111 carried on a bottom surface 93 of the lower landing tread 91 so as to engage with and squarely align the lower landing assembly 90 with the center tread support 100. The side to side dimension 112 of the alignment tab 111 is substantially exactly the same as the side to side dimension 107 of center tread support spacer 110 which ensures secure engagement of the lower landing assembly 90 within the center tread support 100 and automatically "squares" the form 10 when the lower landing assembly 90 is engaged with the center tread support 100. The lower landing tread 91 may, but need not, have the same depth dimension as step treads 40 which assists in facilitating interconnection with an adjacent floor/level of the building (not shown). Further, the lower landing tread 91 may also be dissimilar to the upper landing tread 81 to provide flexibility in sizing the form 10 and ultimate stringer of stairs.

Figure 13:
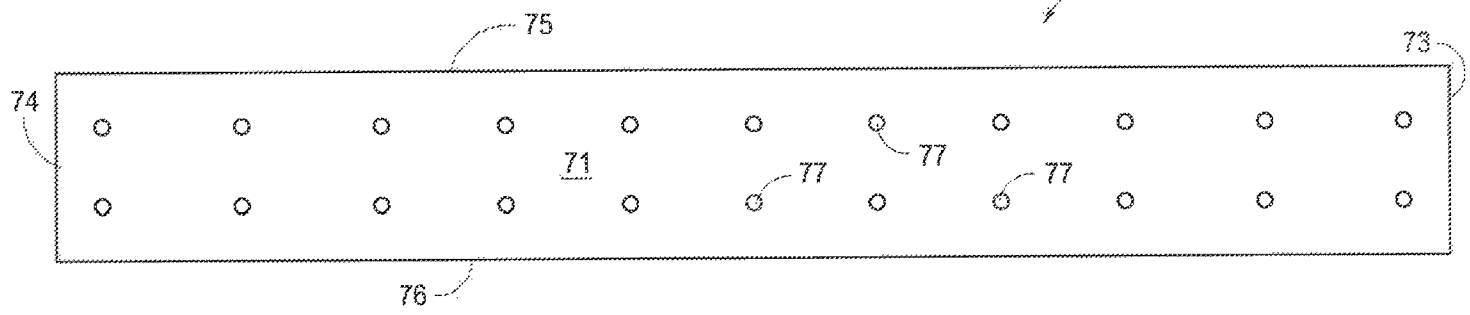
FIG. 13 is an orthographic view of the lower landing endplate showing the plurality of spacedly arrayed holes defined therein for the reinforcing rebar.
Figure 13A:
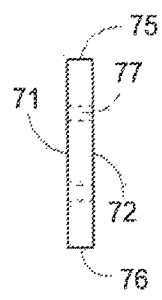
FIG. 13A is an orthographic end view of the lower landing endplate of FIG. 13.

The lower landing tread 91 is generally rectilinear having a top surface 92, a bottom surface 93, a first edge 94, a second edge 95, a first side 96 and a second side 97. Spacedly arrayed holes 126 are predrilled therein for attachment of the upper lower endplate 70. The lower landing endplate 70 (FIG. 13) is generally rectilinear in configuration having a first side 71, a second side 72, a first end portion 73, a second end portion 74, a top edge 75, a bottom edge 76 and defines a plurality of spacedly arrayed rebar holes 77 therein communicating between the first side 71 and the second side 72. Similar to the upper landing end plate 60, precise placement and number of the rebar holes 77 defined in the lower landing end plate 70 is determined during the engineering of the form 10. The number and placement of the rebar holes 77 in the lower landing end plate 70 is not always exactly the same as the number and placement of rebar holes 67 defined in the upper landing end plate 60. The lower landing endplate 70 is attached to first edge 94 of the lower landing tread 91, and the second edge 95 communicates with an adjacent riser 50.

Figure 30:
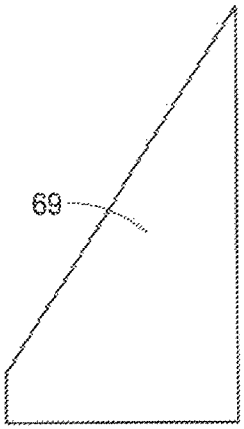
FIG. 30 is an orthographic side view of the lower endplate lock.

Lower endplate lock 69 (FIGS. 1, 30) is joined to the side boards 20A at the first end portion 23 to positionally maintain the lower landing assembly 90 in position.

Figure 25:
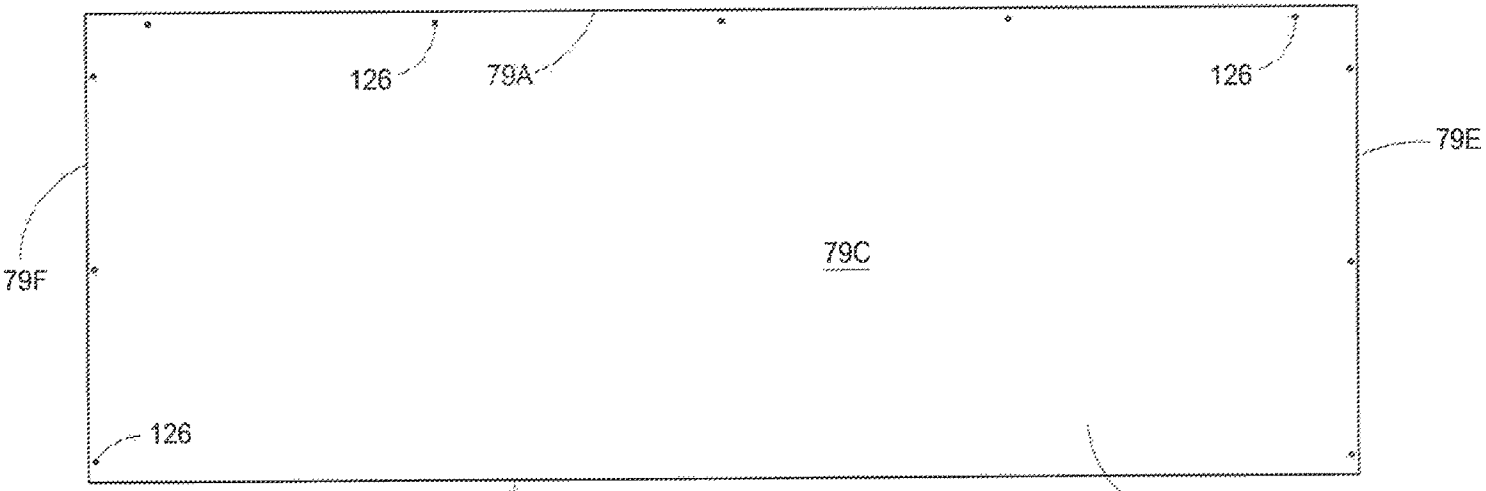
FIG. 25 is an orthographic top view of the lower landing endplate cap.

Lower landing endplate cap 79 (FIG. 25) is rectilinear in configuration and has a top edge 79A, a bottom edge 79B, a top surface 790, a bottom surface 79D, a first edge 79E and a spaced apart second edge 79F. The lower endplate cap 79 engages with an edge 76 of the lower landing endplate 70 and extends between the two spaced apart side boards 20 to engage with the landing slant bottoms 27 defined by each side board 20A. The lower landing endplate cap 79, in combination with the lower landing tread 91 and the lower landing endplate 70 form the lower landing of the stringer of stairs.

Figure 20:
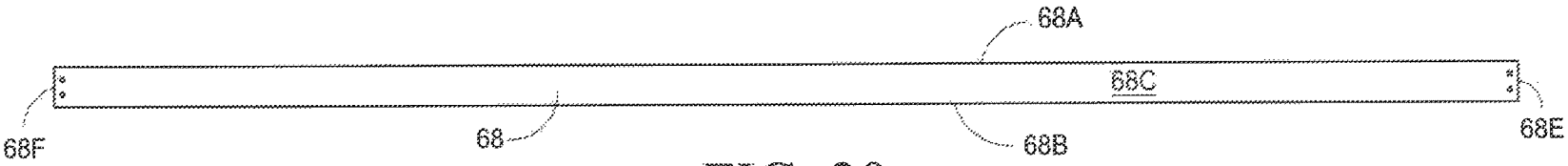
FIG. 20 is an orthographic front view of the upper endplate cap.

An upper landing endplate cap 68 (FIG. 20) is similarly carried at the second upper end portion 20B of the form 10 extending between the side boards 20B spacedly adjacent the upper endplate lock 78. The upper landing endplate cap 68 has a top edge 68A, a bottom edge 68B, a top surface 68C, a bottom surface 68D, a first edge 68E and a second edge 68F. The landing upper endplate cap 68 extends between the two spaced apart side boards 20B and engages with toe angle 28A of the upper landing toe 28. Toe angle 28A is parallel to the angle of the landing slant bottom 27 and also to each tread 40.

The precision precutting of the form components, and especially the precision cut dimensions of the center tread support spacer 110 that spaces apart the center tread supports 100 and the precision cut dimensions of the alignment tabs 111 carried on the bottom surfaces 83, 93 of the upper landing tread 81 and the lower landing tread 91 all contribute to cause the form 10 to square automatically and be properly aligned during construction.

Having disclosed the structure of my apparatus and method for production of precision precast concrete flights of stairs, its operation may be understood.

The first step in the precision precutting of the forms 10 is determining a substantially exact vertical distance between a lower level landing position (not shown) and a vertically adjacent upper level landing position (not shown) in a location where a flight of stairs is to be installed. A substantially exact horizontal distance between the lower level landing position and the vertically adjacent upper level landing position is also determined. Once the substantially exact vertical distance and substantially exact horizontal distance is determined, the number of risers 50 and the number of treads 40 are calculated to determine the number of tread 40 and riser 50 combinations required to span the substantially exact vertical distance and the substantially exact horizontal distance between the lower level landing position and the vertically adjacent upper level landing position while maintaining the treads 40 and the upper landing tread 81 and the lower landing tread 91 in substantially parallel orientation relative to one another, and parallel to the spaced apart levels of the structure (not shown) and while maintaining substantially exactly the same riser height 57 for all of the stair risers 50 and a substantially exactly the same tread depth 47 for all of the stair treads 40. Commonly the maximum vertical rise 57 per riser 50 is seven inches, and in any single flight of stairs there may be no more than 0.25 inch vertical difference in vertical rise 57 from one tread 40 to an adjacent tread 40. Further, in any single flight of stairs, the maximum permitted overall delta (change/difference) in vertical rise 57 from tread 40 to adjacent tread 40, over the entire flight of stairs, is 0.75 inches. For that reason, height variations must be spread out substantially evenly amongst all the risers 50. Therefore the calculation of the number of tread 40 and riser 50 combinations needed to span the previously determined substantially exact vertical distance and the substantially exact horizontal distance must take into account any building code maximum vertical rise 57 which may necessitate a change in number of tread 40 and riser 50 combinations with each riser 50 having a riser height 57 that satisfies the code requirements.

A supporting surface (not shown) upon which the assembled form is to be placed for pouring of concrete (not shown) therein should be flat/horizontal, stable and strong enough to support the weight of the volume of fluidic concrete that will be poured into the form 10. A supporting surface (not shown) that is not flat/horizontal will cause the fluidic concrete to "migrate" to the downhill portion of the form 10 and may result in an inferior product.

Preferably using a computer controlled cutting apparatus (not shown), the individual form 10 components are precision cut from material, such as, but not limited to, High Density Overlay (HDO) plywood and/or fiberboard and/or OSB (oriented strand board) that has a coating 29 on at least one surface to provide a desirable surface to the hardened concrete. The form 10 components comprise plural tread supports 30, each tread support 30 having a first side 31 and a second side 32, a first end portion 33 and a second end portion 34, a bottom edge 36 and a top edge 35, the top edge 35 defining a plurality of intersecting tread cutouts 38 and riser cutouts 37 forming interior angles 39B and exterior angles 39A between the intersecting tread cutouts 38 and riser cutouts 37.

Plural sideboards 20, each sideboard 20 and each sideboard portion 20A, 20B, 20C having a first side 21 and a second side 22, a first end portion 23 and a second end portion 24, a top edge 25, a bottom edge 26 and a coating 29 on at least one side 21, 22, the coating 29 to provide a desired final surface texture to the concrete stringer of stairs, and each side board portion 20A, 20B, 20C carrying a corresponding tread support portion 30A, 30B, 30C on the surface 21, 22 having the coating 29.

Plural stair risers 50, each stair riser 50 having a front surface 51 and a back surface 52, a top edge 53 and a bottom edge 54, a first end 55 and a second end 56 and a coating 29 on at least one surface 52, the coating 29 to provide a desired final surface texture to the concrete stringer of stairs, the top edge 53 and the bottom edge 54 having a precision cut angle thereon to provide for a riser back-set 59 relative to an adjacent stair tread 40, and a riser height 57 between the top edge 53 and the bottom edge 54 that is substantially identical for all of the plurality of stair risers 50.

Plural stair treads 40, each stair tread 40 having a top surface 41 and a bottom surface 42, a first end 45 and a second end 46, a toe edge 43 and a heel edge 44 and a coating 29 on at least one surface 41, the coating 29 to provide a desired final surface texture to the concrete stringer of stairs, the toe edge 43 of each stair tread 40 interconnected with the top edge 53 of a stair riser 50 to form a stair tread 40 and stair riser 50 combination having an interior angle between the stair tread 40 and the stair riser 50 that provides for the back set 59, and a tread depth 47 dimension between the toe edge 43 and the heel edge 44 that is substantially identical for all of the plural stair treads 40.

An upper landing end plate 60 communicating between two spaced apart side boards 20 proximate the second end portion 24, the upper landing end plate 60 having a first side 61 and a second side 62, a first end portion 63 and a second end portion 64, a top edge 65 and a bottom edge 66, the upper landing end plate 60 further defining plural spacedly arrayed rebar holes 67 therein communicating between the first side 61 and the second side 62 for reinforcing rebar (not shown) to be spacedly positioned within the precision cut form 10 to add structural rigidity to the produced concrete flight of stairs.

A lower landing end plate 70 communicating between two spaced apart side boards 20 proximate the first end portion 23, the lower landing end plate 70 having a first side 71 and a second side 72, a first end portion 73 and a second end portion 74, a top edge 75 and a bottom edge 76, the lower landing end plate 70 further defining plural spacedly arrayed rebar holes 77 therein communicating between the first side 71 and the second side 72 for reinforcing rebar (not shown) to be spacedly positioned within the precision cut form 10 to add structural rigidity to the produced concrete flight of stairs.

An upper landing end plate cap 68 having a top edge 68A and a bottom edge 68B, a first surface 68C and a second surface 68D, a first edge 68E and a second edge 68F, the upper landing end cap 68 communicating between upper landing toe angles 28A carried on the top edge 25 of the spaced apart sideboards 20 spacedly adjacent the second end portion 24 of the side boards 20.

A lower landing end cap 79 having a top edge 79A and a bottom edge 793, a top surface 79C and a bottom surface 79D, a first edge 79E and a second edge 79F, the lower landing end cap 79 communicating between landing slant bottoms 27 defined in the first end portions 23 of the side boards 20 to form a bottom surface of a lower landing of the concrete flight of stairs.

An upper landing tread 81 having a top surface 82, a bottom surface 83, a first edge 84, a second edge 85, a first side 86 and a second side 87, and plural spacedly arrayed precision predrilled holes 126 therein, the upper landing tread 81 communicating between the two spaced apart side boards 20 to form an upper landing of the concrete stringer of stairs.

A lower landing tread 91 having a top surface 92, a bottom surface 93, a first edge 94, a second edge 95, a first side 96 and a second side 97, and plural spacedly arrayed precision predrilled holes 126 therein, the lower landing tread 91 communicating between the two spaced apart side boards 20 to form a lower landing of the concrete stringer of stairs.

Plural center tread support spacers 110 for positioning between two parallel spaced apart tread supports 30 to form a center tread support assembly 100, each of the plural center tread support spacers 110 having a first side 101, a second side 100 to, a top edge 103, a bottom edge 104, a first end 105, a second end 106 and a width dimension 107 between the first end 105 and the second end 106.

Plural alignment tabs 111 for predetermined positioning on the bottom surface 93 of the lower landing tread 91 and on the bottom surface 83 of the upper landing tread 81 to facilitate automatic squaring and alignment of the precision cut form 10, each alignment tab 111 having a first side 113, a second side 114, a top edge 115, a bottom edge 116, a first end 117, a second end 118 and a width dimension 112 between the first end 117 and the second end 118. The width dimension 112 is substantially identical to the width dimension 107 of the plural center tread support spacers 110.

End plate locks 69, 78 for releasable attachment to the side boards 20 immediately adjacent the upper landing end plate 60 and immediately adjacent the lower landing end plate 70 to positionally secure the upper landing end plate 60 and the lower landing end plate 70 in a predetermined position relative to the adjacent side boards 20, and splice boards 130 for releasably interconnecting adjacent side board portions 20A, 20B, 20C and adjacent tread supports 30A, 30B, 30C.

If inlays (not shown) are to be used within the form 10, the inlays are similarly precision cut, as are the locations within the form 10 components whereat the inlays may be positioned. A plurality of precision drilled fastener holes 126 and alignment dowel holes 128, are drilled into the various precut components at predetermined spacedly arrayed positions for the use of threaded fasteners (not shown) and dowels (not shown) to extend therethrough and securely interconnect the various components.

Tread supports 30A, 30B, 30C are interconnected with the side board portions 20A, 20B, 20C with the second side 32 of each tread support 30 immediately adjacent to the first side 21 of each side board 20 portion and with the bottom edge 36 of each tread support 30 aligned with the bottom edge 26 of each side board 20. This invention may utilize as few as one side board portion 20A, 203, 20C, or more than 3 interconnected side board portions 20A, 20B, 20C, although the present drawings show 3 side board portions 20A, 20B, 20C, the invention uses as many as or as few as the particular configuration requires.

Figure 24:
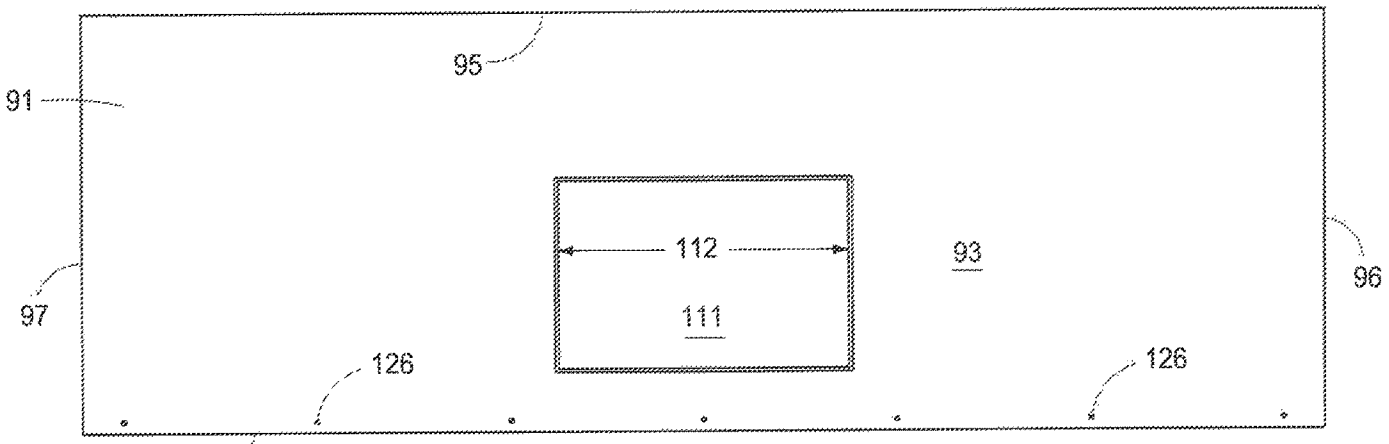
FIG. 24 is an orthographic bottom view of the lower landing tread showing placement of the alignment tab for engagement with the center tread support.

In the preferred embodiment, the tread support portions 30A, 30B, 30C are interconnected to the respective side board portions 20A, 20B, 20C at the manufacturing facility rather than during form 10 assembly in the field. An alignment tab 111 is fixedly secured to the bottom surface 93 of the lower landing tread 91 (FIG. 24). Similarly, an alignment tab 111 is fixedly attached to the bottom surface 83 of the upper landing tread 81 to ensure alignment thereof with the center tread support 100 and squareness of the assembled form 10.

Figure 19:
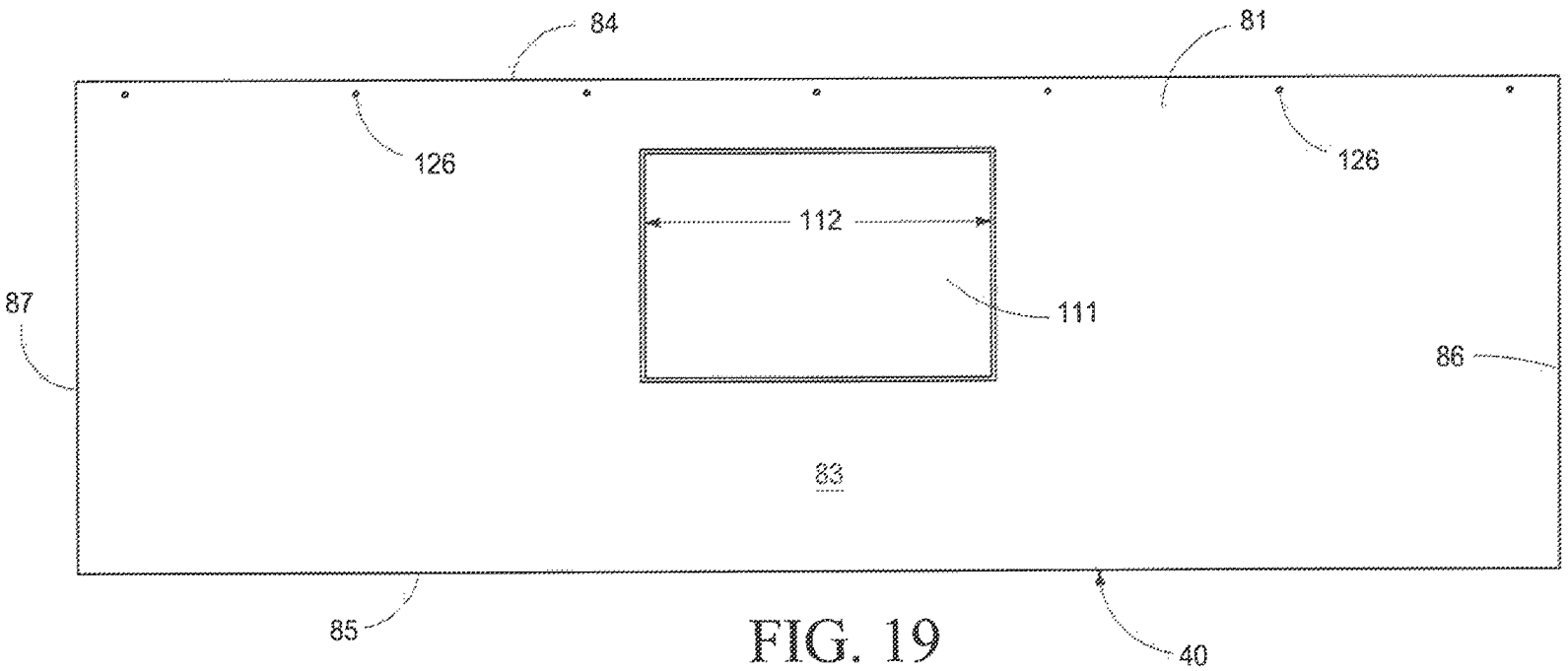
FIG. 19 is an orthographic bottom view of the upper landing assembly tread showing placement of the alignment tab for engagement with the center tread support.

The center tread support 100 is assembled. If the center tread support 100 has a first portion 30A, and a second portion 30B and an intermediate portion 30C, the first portion 30A is joined to the intermediate section 30C using a splice plate 130 and threaded fasteners (not shown) which is thereafter joined to the second portion 30 Busing another splice plate 130 and threaded fasteners (not shown) that are passed through the predrilled holes 126 defined therein. The second parallel center tread support 100 is similarly constructed and is oriented parallel to and spacedly adjacent the first assembled center tread support 100. A center tread support spacer 110, which is generally rectilinear having a first side 101, a second side 102, a top edge 103, a bottom edge 104, a first end 105, a second end 106 and a width dimension 107 between the first end 105 and the second end 106 is interconnected with both center tread supports 100 to extend generally perpendicularly transversely therebetween using alignment dowels (not shown) that engage in the predrilled alignment dowel holes 128. Additional center tread support spacers 110 are added to the center tread support assembly 100 to extend generally perpendicularly transversely between the two parallel tread supports 30 to maintain rigidity and strength of the center tread support assembly 100. (See FIG. 33.) The side to side width dimension 107 between the two spaced apart, and parallel, center tread supports 100 is critical to the "squaring" of the form 10 because the side-to-side width dimension 107 of the center tread support spacer 100 is substantially identical to the side-to-side width dimension 112 of the alignment tabs 111, (FIGS. 19, 24). If an additional center tread support (not shown) is to be interconnected to the previously assembled center tread assembly 100 to provide support for treads 40 having greater tread widths 48, the additional center tread support(s) is similarly assembled and interconnected using additional center tread support spacers 100 and alignment dowels (not shown).

After the center tread support assembly 100 has been assembled and placed on the flat supporting surface (not shown) the tread 40 and riser 50 combinations are assembled. (FIG. 16). Each tread 40 is positioned so that the toe edge 43 overlaps the top edge 53 of its adjacent riser 50. As noted previously, the angle between the top surface 41 of each tread 40, and the top edge 53 of each riser 50 is an acute interior angle that provides for the back set 59 required by building codes. (See FIG. 18). The coating 29 of the form 10 components is positioned immediately adjacent to the interior acute angle to provide a desired surface on the hardened concrete 122. The first end 45 of each tread 40 is aligned with the first end 55 of each riser 50. Similarly, the second end 46 of each tread 40 is aligned with the second end 56 of each riser 50. It is essential the ends 45, 55 and 46, 56 are aligned so as to provide a tight interconnection with the tread supports 30 and the side boards 20. In the preferred embodiment, the treads 40 are interconnected with the risers 50 using a plurality of finishing nails, such as "brads" (not shown) that are driven through the tread 40 and into the top edge 53 of the riser 50. A pneumatic tool such as a nail gun (not shown) has found to be effective in this task. Alternatively, other methods of connecting the tread to the riser may be used, including mechanical connectors (not shown) and shaped wood joints (not shown). Because the top surface 41 of each tread 40 and the front surface 51 of each riser 50 is imprinted directly into the fluidic concrete, it is essential that the top surface 41 of the tread 40 and the front surface 51 of the riser 50 are blemish-free and further that the fastening brads (not shown) do not form surface defects in the treads 40 or risers 50 such that they cause imperfections that would be transferred to the hardened fluidic concrete. Further, as shown in the drawings, the tread 40 and the riser 50 combinations are assembled with the toe edge 43 of each tread 40 overlapping the top edge 53 of the adjacent riser 50. This overlap construction uses the weight of the fluidic concrete within the form 10 to force the seams and joints of the tread 40 and riser 50 combination into tighter engagement.

As can be determined from viewing FIG. 1, the previously assembled upper landing assembly 80 is placed within of the assembled center tread support assembly 100 at the upper end portion 34 so that the riser 50 is within of the riser cutout 37 and the bottom edge 54 of the riser 50 is oriented upwardly. An assembled a tread 40 and riser 50 combination is then positioned within the next tread cutout 38 and riser cutout 37 so that the bottom surface 42 of the tread 40 frictionally contacts the bottom edge 54 of the previously placed riser 50 and overlaps the bottom edge 54. The plurality of assembled tread 40 and riser 50 combinations are thereafter positioned within the center tread support 100 with the bottom surface 42 of each tread 40 resting within a tread cutout 38 and the front surface 51 of each riser 50 frictionally resting within a riser cutout 37. The tread 40 and riser 50 combinations are placed in the center tread support assembly 100 extending along the entire length of the center tread support assembly 100. When the lowermost tread 40 and riser 50 combination is positioned, the previously assembled lower landing assembly 90 with the alignment tab 110 on the bottom surface 92 thereof is positioned in the center tread support 100 with the alignment tab 111 engaged in the center tread support 100.

The side boards 20 carrying the side tread supports 30 are interconnected to the tread 40 and riser 50 combinations positioned on the center tread support assembly 100. The tread supports 30, have the same configuration as the center tread support assembly 100 with riser cutouts 37 and tread cutouts 38 with corners 39A, 39B therebetween engage with each of the tread 40 and riser 50 combinations supported by the center tread support assembly 100. As noted previously, if the side boards 20 necessitate a first portion 20A, a second portion 20B and an intermediate portion 20C, those portions 20A, 20B and 20C are interconnected with one another using splice plates 130 and fasteners (not shown). The position of the splice plates 130 is adjacent to the bottom edge 26, 36 of the side boards 20 and tread supports 30.

Threaded fasteners (not shown) are inserted through the plurality of spacedly arrayed predrilled holes 126 defined in the side boards 20 extending from the second side 22 through the first side 21 to engage with the first and second ends 45, 55 and 46, 56 respectively of the assembled tread 40 and riser 50 combinations. The threaded fasteners (not shown) secure the side boards 20 and tread supports 30 to the tread 40 and riser 50 combinations and further add rigidity to the form 10 by communicating between the tread 40 and riser 50 combinations and the underlying supporting surface (not shown) so as to support the great weight of a large amount of fluidic concrete 122 that will be contained within the form 10.

The lower endplate lock 69 having been previously attached to the first surface 21 of each side board 20 immediately adjacent to the lower landing endplate 70 secures the lower landing endplate 70 in position. The lower endplate cap 79 is installed using threaded fasteners (not shown) to securely attach the lower endplate cap 79 to the landing slant bottom 27 of each side board 20, and also to the top edge 75 of the lower landing endplate 70.

After the upper landing endplate 60 is installed between the two spaced apart side boards 20B, an upper endplate lock 78, which is a triangular member, is attached to each side board 20 at the upper landing toe 28. The upper endplate lock 78 securely retains the upper landing endplate 60 in position. An upper endplate cap 68 is thereafter installed to extend generally transversely between the two spaced apart side boards 20 on the upper landing toe angle 28A. Proper positioning of the upper endplate cap 68 provides a gap between the upper endplate cap 68 and the upper landing endplate 60 which allows an additional volume of fluidic concrete 122 to be installed into the form 10 and also provides a location for "rodding" of the fluidic concrete 122 to prevent the formation of air bubbles and voids that might otherwise form in the upper end portion of the stringer of stairs. As can be seen in FIGS. 1 and 2, the ultimately produced stringer has a protrusion at the first end portion 24 that extends angularly upwardly above the top edge 25 of the side boards 20. The upper landing toe 28, upper endplate cap 68 and the gap between the upper endplate cap 68 and the upper landing endplate 60 allow the additional volume of concrete to be added into this protrusion which provides a interconnection between the produced concrete stringer of stairs and the upper level of the structure (not shown).

Once the form 10 is assembled, stringer components, including but not limited to, reinforcing rebar (not shown), nosings (not shown), embeds (not shown), electrical conduit (not shown), "lifting bar" (not shown) and handrail brackets (not shown) may be placed within the form 10 at predetermined positions for inclusion within the produced stringer. The reinforcing rebar (not shown) placed within the form 10 extends the length of the form 10 from the upper landing endplate 60 to the lower landing endplate 70 and is intended to pass through the plurality spacedly arrayed rebar holes 67, 77 respectively defined in the upper landing endplate 60 and the lower landing endplate 70. Due to building codes, all reinforcing rebar (not shown) must be fully encased within the "throat" of the stringer which is the depth of the stringer extending from the heel of any step to the opposing back surface of the stringer. Chamfers (not shown) may also be added to the corners between the treads 40 and risers 50 at the toe portion 43 and also at the heel portion 44 if desired by appropriate placement within the form 10. Additional side panels (not shown) may be added for form stability (if necessary), and strong backs (not shown) may be added to the top of the form to further assist with form stability and rebar placement.

Once the form 10 is completely assembled, a nonstick coating or releasing agent such as, but not limited to linseed oil or a water based releasing agent may be applied to all the interior surfaces of the form 10 to further inhibit any sticking of the concrete as it hardens.

A volume of fluidic concrete is added into the form 10 beginning at the upper landing assembly 80 end portion to flow downwardly and fully fill the tread 40 and riser 50 combinations, the upper landing and the lower landing. The form 10 is filled up to the point where the fluidic concrete is level with the top surface 25 of the side boards 20 or another predetermined level. Appropriate "rodding" and/or vibration may be applied to the fluidic concrete to reduce and eliminate the presence of air bubbles and voids and to ensure that the fluidic concrete fully fills the form 10.

In the preferred embodiment, self-consolidating concrete (SCC) is the preferred type of fluidic concrete that is used in the form 10 because such self-consolidating concrete flows "like water" easily into all of the gaps and crevices and angles within the form 10 and provides a superior external surface of the finished product. After the fluidic concrete has "set" for a predetermined period of time, an additional amount of fluidic concrete is added through the gap (not shown) between the upper landing endplate 60 and the upper end plate cap 68 to form the protuberance at the upper end landing of the stringer.

Depending upon the overall dimensions of the stringer of stairs to be produced, a hollow pipe (not shown) may be added to the form 10 to extend between the first side board 20 and the spaced apart second side board 20 at a generally medial position between the first end portion 23 and the second end portion 24. The hollow pipe (not shown) which passes between and amongst the reinforcing rebar (not shown) provides a means to insert a lifting rod (not shown) through a central portion of the finished stringer to assist in the lifting and manipulation of the finished stringer such as to remove it from the form 10 after the concrete has hardened, and also to assist in ultimate placement of the stringer in a final location. The presence of a medially located lifting position reduces stresses placed on the stringer, caused by lifting the stringer from its opposing end portions which might cause the stringer to fracture in the middle.

Once the semi-fluidic concrete has hardened, the form is disassembled by removal of the threaded fasteners holding the lower endplate lock 69 and the upper endplate lock 78 in place. Thereafter the upper landing endplate 60 and the lower landing endplate 70 are removed by similarly removing the threaded fasteners. Thereafter, the two side boards 20 carrying the tread supports 30 are removed from the tread 40 and riser 50 combinations by removal of the threaded fasteners extending therethrough. Upon removal of the side boards 20 the finished stringer may be lifted vertically off the tread 40 and riser 50 combinations supported by the center tread support 100 and the finished stringer may be moved to a position for final finishing and installation in a predetermined location to extend between the vertically adjacent levels of the structure.

The method for forming a precision precast concrete flight of stairs to provide access between vertically spaced apart levels of a structure comprising the steps:

Determining a substantially exact vertical distance between a predetermined lower level landing position and a predetermined vertically adjacent upper level landing position.

Determining a substantially exact horizontal distance between the predetermined lower level landing position and the predetermined vertically adjacent upper level landing position.

Calculating a number of equally dimensioned stair risers 50 and a number of equally dimensioned stair treads 40 to span the substantially exact vertical distance and the substantially exact horizontal distance between the lower level landing position and the vertically adjacent upper level landing position while maintaining the stair treads 40 in substantially parallel orientation relative to one another and parallel relative to the vertically spaced apart levels of the structure.

Precision cutting from cellulosic material form 10 components, for forming the precision precast concrete flight of stairs, and precision drilling a plurality of holes 126, 128 therein at predetermined spacedly arrayed positions to facilitate assembly and disassembly of the precision cut form 10, the precision cut form components comprising sideboards 20, tread supports 30, stair risers 50, stair treads 40, upper landing end plates 60, lower landing end plates 70, upper landing end caps 68, lower landing end caps 79, upper landing treads 81, lower landing treads 93, center tread support spacers 110, alignment tabs 111 and end plate locks 69, 78.

Interconnecting the tread support portions 30A, 30B, 30C to the corresponding sideboard portions 20A, 20B, 20C.

Assembling the stair riser 50 and the stair tread 40 combinations by interconnecting each stair riser 50 with a stair tread 40 along adjacent edge portions with a stair tread toe edge 43 overlapping the stair riser top edge 53.

Assembling a center tread support assembly 100 from plural tread supports 30 and plural center tread support spacers 110 by interconnecting the plural center tread support spacers 110 between the plural tread supports 30 with plural alignment dowels (not shown) so that the center tread support spacers 110 extend generally perpendicularly transversely between the parallel spaced apart tread supports 30 forming the center tread support assembly 100.

Assembling an upper landing assembly 80 with the upper landing tread 81, the upper landing end plate 60 and a stair riser 50 and attaching an alignment tab 111 to a bottom surface 83 of the upper landing tread 81 for aligning and squaring the upper landing assembly 80 within the assembled center tread support assembly 100.

Assembling a lower landing assembly 90 with the lower landing tread 91 and the lower landing end plate 70 and attaching an alignment tab 111 to a bottom surface 93 of the lower landing tread 91 for aligning and squaring the lower landing assembly 90 within the assembled center tread support assembly 100.

Positioning the assembled center tread support assembly 100 on a horizontal supporting surface and positioning the assembled upper landing assembly 80 within the assembled center tread support assembly 100, at one end portion thereof, and engaging the alignment tab 111 carried on the bottom surface 83 of the upper landing tread 81 within the assembled center tread support assembly 100 to square and align the upper landing assembly 80 within the assemble center tread support assembly 100.

Positioning the assembled riser 50 and tread 40 combinations within the assembled center tread support assembly 100 beginning immediately adjacent the positioned upper landing assembly 80 and continuing the positioning of the assembled riser 50 and tread 40 combinations to an end of the assembled center tread support assembly 100 opposite the positioned upper landing assembly 80.

Positioning the assembled lower landing assembly 90 within the assembled center tread support assembly 100, at the end opposite the upper landing assembly 80 and engaging the alignment tab 111 carried on the bottom surface 93 of the lower landing tread 91 within the assembled center tread support assembly 100 to square and align the stair treads 40, stair risers 50 and landing assemblies 80, 90 within the center tread support assembly 100.

Positioning and interconnecting with fasteners (not shown) the sideboards 20 to each side of the upper landing assembly 80, the riser 50 and tread 40 combinations and the lower landing assembly 90 positioned within the center tread support assembly 100, the fasteners extending through the precision drilled holes 126 defined in the sideboards 20.

Positioning, aligning and interconnecting with fasteners an upper end plate cap 68 adjacent the upper landing assembly 80, the upper end plate cap 68 extending transversely between the spaced apart side boards 20 and interconnecting with the upper landing toe 28 carried on each side board 20.

Positioning, aligning and interconnecting with fasteners a lower end plate cap 79 adjacent the lower landing assembly 90, the lower end plate cap 79 extending transversely between the spaced apart side boards 20 and interconnecting with a landing slant bottom 27 defined in each side board 20 at the end portion 23 opposite the upper landing assembly 80.

Positioning and interconnecting with fasteners (not shown) an end plate lock 69, 78 on each sideboard 20 immediately adjacent the lower landing end plate 70 and immediately adjacent the upper landing end plate 60 to positionally secure the landing end plates 60, 70 relative to the sideboards 20.

Installing reinforcing rebar within the assembled form 10 to provide structural rigidity to the precision precast concrete flight of stairs.

Positioning a lifting bar pipe (not shown) within the assembled form 10 to extend generally transversely between the two spaced apart sideboards 20 at a generally medial position between the upper landing assembly 80 and the lower landing assembly 90 to provide a lifting and manipulation point for the produced concrete stringer of stairs.

Adding flowable concrete, which is preferably self-consolidating concrete, into the assembled form 10, and allowing the flowable concrete 122 to cure and harden.

Removing the end plate locks 69, 78, removing the end plate caps 68, 79 and removing the sideboards 20 from the hardened precast concrete flight of stairs by removing the fasteners (not shown).

Harvesting the cured/hardened precision precast concrete flight of stairs from the partially disassembled precision form 10.

Thereafter, the side boards 20 carrying the associated tread supports 30 are reconnected to the tread 40 and riser 50 combinations using the threaded fasteners (not shown), the upper and lower landing endplates 60, 70 respectively are reattached as are the lower endplate locks 69 and the upper endplate locks 78. Thereafter the form 10 is prepared for an additional pouring of fluidic concrete 122 therein after installation of the stringer interior components such as reinforcing rebar and the like.

I claim:

1. A reusable and self-squaring precision cut formwork for precision forming and squaring a concrete stringer of stairs to provide access between vertically spaced apart levels of a structure, the precision cut formwork comprising:

a plurality of tread supports, each of the plurality of tread supports formed of wood and having, a first side and a second side, a first end and a second end, a linear bottom edge and a top edge, the top edge defining a plurality of intersecting tread cutouts and riser cutouts forming alternating interior angles and exterior angles between the intersecting tread cutouts and riser cutouts and the first and second sides of each of the plurality of tread supports define a plurality of precision located spacedly arrayed alignment dowel holes;

a plurality of side boards, each of the plurality of boards formed of wood and each of the plurality of side boards having a first side and a second side, a first end and a second end, a top edge, and a linear bottom edge, and each of the plurality of side boards defines a plurality of precision located spacedly arrayed fastener holes, and each of the plurality of side boards carries a tread support on one of the first or second side of the respective side board, and the carried tread support is aligned on the respective side board so that the linear bottom edge of the carried tread support is co-planar with the linear bottom edge of the respective side board so that both linear bottom edges simultaneously rest upon an underlying supporting surface;

a center tread support, the center tread support having at least two parallel spaced apart tread supports that are arranged parallel to one another and spaced apart from one another, and at least two center tread support spacers, each of the at least two center tread support spacers having a first side, a second side, a top edge, a linear bottom edge, a first end, a second end and having a pre-determined width dimension between the first end and the second end, and the first end and the second end of each center tread support spacer define plural spacedly arrayed alignment dowel holes to engage with alignment dowels for interconnection with the at least two parallel spaced apart tread supports to form the center tread support, and the at least two center tread support spacers are positioned between and extend perpendicularly and transversely relative to the at least two parallel and spaced apart tread supports so that a width dimension between the at least two parallel spaced apart tread supports is the same as the predetermined width dimension of the at least two center tread support spacers, and the linear bottom edges of the two parallel spaced apart tread supports, and the linear bottom edge of the at least two center tread support spacers are co-planar with each other, and are also co-planar with the linear bottom edges of the plurality of side boards upon the underlying supporting surface;

a plurality of tread-riser combinations to releasably engage with the plurality of tread supports carried by the respective plurality of sideboards and the center tread support and within the tread cutouts and riser cutouts defined by the plurality of tread supports, each tread-riser combination having, a stair riser formed of wood and with a front surface and a back surface, a top edge and a bottom edge, a first end and a second end, the top edge and the bottom edge both having a precision pre-cut angle thereon to provide for a riser back-set relative to an adjacent tread-riser combination, and a height dimension between the top edge and the bottom edge that substantially identical for each stair riser, and a stair tread formed of wood and releasably interconnected to each stair riser, each stair tread with a top surface and a bottom surface, a first end and a second end, a toe edge and a heel edge, the toe edge of each stair tread releasably interconnected with the top edge of the stair riser to form the tread-riser combination having an interior angle between the stair tread and the interconnected stair riser that provides for the riser back-set, and a tread depth dimension between the toe edge and the heel edge that is substantially identical for each stair tread;

an upper landing assembly that releasably engages with at least two of the tread supports carried by the respective sideboards and the center tread support and within the tread cutouts and riser cutouts defined therein, the upper landing assembly having, an upper landing tread formed of wood and releasably communicating between the respective plurality of side boards at the second end of each of the respective plurality of sideboards to form an upper landing of the precision formed concrete stringer of stairs, the upper landing tread having a top surface, a bottom surface, a first edge, a second edge, a first side and a second side, and defining a plurality of precision predrilled holes therein, an alignment tab precision fixedly secured on the bottom surface of the upper landing tread to provide automatic squaring and alignment of the precision cut formwork, the alignment tab having a first side, a second side, a top edge, a bottom edge, a first end, a second end and a width dimension between the first end and the second end that is substantially identical to the predetermined width dimension of the at least two center tread support spacers and substantially identical to the width dimension between the two parallel spaced apart tread supports of the center tread support, an upper landing end plate formed of wood and releasably communicating between the respective plurality of side boards at second end of each the respective plurality of side boards, the upper landing end plate having a first side and a second side, a first end and a second end, a top edge and a bottom edge, the upper landing end plate further defining plural spacedly arrayed rebar holes therein communicating between the first side and the second side of the upper landing end plate for reinforcing rebar to be spacedly positioned within the precision cut formwork to add structural rigidity to the produced concrete stringer of stairs, an upper landing end plate cap formed of wood having a top edge and a bottom edge, a first surface and a second surface, a first end and a second end, the upper landing end plate cap communicating between upper landing toes on the top edge of each of the respective plurality of sideboards spacedly adjacent the second end of each of the respective plurality of side boards, a lower landing assembly that releasably engages with at least two of the tread supports carried by the respective plurality of sideboards and the center tread support and within the tread cutouts and riser cutouts defined therein, the lower landing assembly having, a lower landing tread formed of wood and releasably communicating between the respective plurality of side boards at the first end of each of the respective plurality of side boards to form a lower landing of the precision formed concrete stringer of stairs, the lower landing tread having a top surface, a bottom surface, a first edge, a second edge, a first side and a second side, and defining a plurality of precision predrilled holes therein, an alignment tab precision fixedly secured on the bottom surface of the lower landing tread to provide automatic squaring and alignment of the precision cut formwork, the alignment tab having a first side, a second side, a top edge, a bottom edge, a first end, a second end and a width dimension between the first end and the second end that is substantially identical to the predetermined width dimension of the at least two center tread support spacers and substantially identical to the width dimension between the two parallel spaced apart tread supports of the center tread support, a lower landing end plate formed of wood and releasably communicating between the respective plurality of side boards at first end of each of the respective plurality of side boards, the lower landing end plate having a first side and a second side, a first end portion and a second end, a top edge and a bottom edge, the lower landing end plate further defining plural spacedly arrayed rebar holes therein communicating between the first side and the second side of the lower landing end plate for reinforcing rebar to be spacedly positioned within the precision cut formwork to add structural rigidity to the produced concrete stringer of stairs, a lower landing end plate cap having a top edge and a bottom edge, a top surface and a bottom surface, a first end and a second end, the lower landing end plate cap communicating between landing slant bottoms defined in the first end of each of the respective plurality of side boards to form a bottom surface of a lower landing of the concrete stringer of stairs; and an end plate lock releasably attachable to each one of the respective plurality of side boards adjacent the upper landing end plate and an end plate lock releasably attachable to each one of the respective plurality of side boards adjacent the lower landing end plate to positionally secure the upper landing end plate and the lower landing end plate in a predetermined position relative to the respective plurality of side boards and to maintain squareness of the formwork.

2. The reusable and self-squaring precision cut formwork for precision forming and self-squaring a concrete stringer of stairs of claim 1 wherein each of the plurality of side boards has an upper landing toe on the top edge of each of the plurality of side boards at second end of each of the plurality of side boards, and the upper landing toe of each of the plurality of side boards defines an angle to provide an angulated mounting surface for the upper landing end cap.

3. The reusable and self-squaring precision cut formwork for precision forming and self-squaring a concrete stringer of stairs of claim 1 wherein each of the plurality of sideboards defines a lower landing slant bottom on the first end of each of the plurality of sideboards, the lower landing slant bottom communicating between the top edge of each of the plurality of side boards and the first end of each of the plurality of side boards to provide an angulated mounting surface for the lower landing end cap.

4. The reusable and self-squaring precision cut formwork for precision forming and self-squaring a concrete stringer of stairs of claim 1 further comprising:

rebar within the formwork extending between, and communicating with, the upper landing end plate and the lower landing end plate to provide structural reinforcement to the formed concrete stringer of stairs.

* * * * *